US009915883B2

(12) United States Patent
Kawamura et al.

(10) Patent No.: US 9,915,883 B2
(45) Date of Patent: Mar. 13, 2018

(54) TONER

(71) Applicant: Konica Minolta, Inc., Tokyo (JP)

(72) Inventors: Takaki Kawamura, Tokyo (JP); Kenshi Miyajima, Tokyo (JP); Junya Ueda, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/272,670

(22) Filed: Sep. 22, 2016

(65) Prior Publication Data

US 2017/0242358 A1 Aug. 24, 2017

(30) Foreign Application Priority Data

Feb. 19, 2016 (JP) ..... 2016-030119

(51) Int. Cl.

*G03G 9/087* (2006.01)
*G03G 9/08* (2006.01)
*G03G 9/093* (2006.01)

(52) U.S. Cl.

CPC ..... *G03G 9/0821* (2013.01); *G03G 9/0825* (2013.01); *G03G 9/08711* (2013.01); *G03G 9/08755* (2013.01); *G03G 9/08797* (2013.01); *G03G 9/093* (2013.01); *G03G 9/09364* (2013.01); *G03G 9/09371* (2013.01)

(58) Field of Classification Search

CPC ..... G03G 9/09371; G03G 9/09364; G03G 9/0825; G03G 9/0821; G03G 9/08755; G03G 9/08797
USPC ..... 430/110.1, 110.2
See application file for complete search history.

(56) References Cited

U.S. PATENT DOCUMENTS 8,524,434 B2 * 9/2013 Tominaga ..... G03G 9/09314 430/109.1
2016/0246198 A1 * 8/2016 Fujisaki ..... G03G 9/08755

FOREIGN PATENT DOCUMENTS

| | | | |
|---|---|---|---|
| JP | 2004309996 | A | 11/2004 |
| JP | 2012-068341 | A | 4/2012 |
| JP | 2013-109237 | A | 6/2013 |
| JP | 2013156522 | A | 8/2013 |
| JP | 2014-056143 | A | 3/2014 |
| JP | 2014-174315 | A | 9/2014 |
| JP | 2014-228717 | A | 12/2014 |
| JP | 2014-235394 | A | 12/2014 |
| JP | 2015-200733 | A | 11/2015 |
| JP | 2016-024345 | A | 2/2016 |
| WO | 2014/042193 | A1 | 3/2014 |

OTHER PUBLICATIONS

Decision of Rejection dated May 16, 2017 from Japanese Patent Application No. JP 2016-030119 and English translation; Total of 11 pages.
Notice of Reasons for Rejection dated Feb. 14, 2017 from corresponding Japanese Patent Application No. JP 2016-030119 and English translation; Total of 10 pages.

* cited by examiner

*Primary Examiner* — Janis L Dote
(74) *Attorney, Agent, or Firm* — Lucas & Mercanti, LLP

(57) ABSTRACT

The toner of the present invention is an electrostatic latent image developing toner, and has a toner base particle. The toner base particle contains a binder resin including a crystalline resin, and a release agent. The toner has the maximum value $G'_{MAX}$ at a temperature equal to or lower than Tm, among specific storage elastic modulus ratios, of 2.2 or more. The Tm represents a peak top temperature (° C.) of a specific endothermic peak in DSC of the toner.

9 Claims, 2 Drawing Sheets

TONER

CROSS REFERENCE TO RELATED APPLICATIONS

This application is entitled to and claims the benefit of Japanese Patent Application No. 2016-030119, filed on Feb. 19, 2016, the disclosure of which including the specification, drawings and abstract is incorporated herein by reference in its entirety.

BACKGROUND OF THE INVENTION

1. Field of the Invention

The present invention relates to a toner for developing an electrostatic charge image.

2. Description of Related Art

A toner for developing an electrostatic charge image (hereinafter, also simply referred to as "toner") used in electrophotographic image forming is demanded to have reduced thermal energy in fixation for the purposes of an increase in printing speed and saving of energy of an image forming apparatus. In response thereto, a toner with a much better low-temperature fixability is demanded.

With respect to such a toner, for example, a toner is known into which a crystalline polyester having sharp meltability is introduced as a binder resin to thereby regulate a rheological property and control a viscoelastic behavior, thereby allowing the toner to simultaneously satisfy low-temperature fixability, and offset resistance for prevention of a damage to an image due to a conveyance roller or the like (see, e.g., Japanese Patent Application Laid-Open No. 2004-309996).

The toner is also known to, for example, have a predetermined ratio of the viscosity and the elasticity upon solidification after melting, to thereby simultaneously satisfy low-temperature fixability, toner storage stability, and resistance against adhesion in paper ejection. Such a toner dominantly exhibits a restoration behavior like a rubber as a toner that forms an image even in the state where adhesion of paper ejected can occur in fixation. Therefore, adhesion of paper ejected can be suppressed (see, e.g., Japanese Patent Application Laid-Open No. 2013-156522).

While the toner described in Japanese Patent Application Laid-Open No. 2004-309996 has an enhanced solidification speed, the toner may be insufficient in stability of fixation of a printed image, to cause, for example, tucking in the image. In addition, while the toner described in Japanese Patent Application Laid-Open No. 2013-156522 is considered to be effective for suppression of such tucking, the elastic recovery thereof can be strong to make the surface of an image hard, resulting in cracking of the surface of a layer of the toner molten forming an image when the image is smeared, and the portion cracked may be peeled off from the image to thereby result in an insufficient image density.

SUMMARY OF THE INVENTION

An object of the present invention is to provide a toner containing a crystalline resin, the toner sufficiently having all of low-temperature fixability, high-temperature storage property, document offset resistance and smear resistance.

To achieve at least one of the abovementioned objects, an electrostatic latent image developing toner reflecting one aspect of the present invention includes: a toner base particle that contains a binder resin including a crystalline resin, and a release agent, wherein $G'_{MAX}$ is 2.2 or more. The $G'_{MAX}$ represents a maximum value of a ratio of $G'_{1^\circ\ C./min}$ to $G'_{5^\circ\ C./min}$ at a temperature equal to or lower than Tm, the $G'_{5^\circ\ C./min}$ represents a storage elastic modulus (Pa) in temperature drop measured in the range from 100° C. to 25° C. in conditions of a frequency of 1 Hz and a rate of temperature drop of 5° C./min of the toner, the $G'_{1^\circ\ C./min}$ represents a storage elastic modulus (Pa) in temperature drop measured in the range from 100° C. to 25° C. in conditions of a frequency of 1 Hz and a rate of temperature drop of 1° C./min of the toner, and the Tm represents a peak top temperature (° C.) of an endothermic peak positioned at a highest temperature in a first temperature rise process at 10° C./min in differential scanning calorimetry of the toner.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

It is commonly known that, in order to enhance low-temperature fixability of a toner using a crystalline resin (crystalline polyester), the degree of compatibilization of the crystalline resin in a binder resin is increased. In such a case, however, the crystalline resin tends to be made compatible from the stage of toner production, and the toner tends to be deteriorated in high-temperature storage property. In addition, the crystalline resin is compatible in the binder resin even after fixation, thereby causing the glass transition temperature of an amorphous resin in the binder resin to be easily lowered. Therefore, tucking tends to occur in an image, and the image is flexible to thereby tend to be deteriorated in resistance against smearing of the image. An object of the present invention is to simultaneously satisfy low-temperature fixability, and high-temperature storage property, document offset resistance and smear resistance.

A toner of one embodiment of the present invention is an electrostatic latent image developing toner containing a toner base particle, in which the toner base particle contains a binder resin including a crystalline resin. The toner has a $G'_{MAX}$ of 2.2 or more.

The $G'_{MAX}$ represents the maximum value of a ratio of $G'_{1^\circ\ C./min}$ to $G'_{5^\circ\ C./min}$ at a temperature equal to or lower than Tm. Here, the $G'_{5^\circ\ C./min}$ represents a storage elastic modulus (Pa) in temperature drop measured in the range from 100° C. to 25° C. in conditions of a frequency of 1 Hz and a rate of temperature drop of 5° C./min of the toner, and the $G'_{1^\circ\ C./min}$ represents a storage elastic modulus (Pa) in temperature drop measured in the range from 100° C. to 25° C. in conditions of a frequency of 1 Hz and a rate of temperature drop of 1° C./min of the toner. In addition, the Tm represents a peak top temperature (° C.) of an endothermic peak positioned at the highest temperature in a first temperature rise process at 10° C./min in differential scanning calorimetry (DSC) of the toner.

Figure 1:
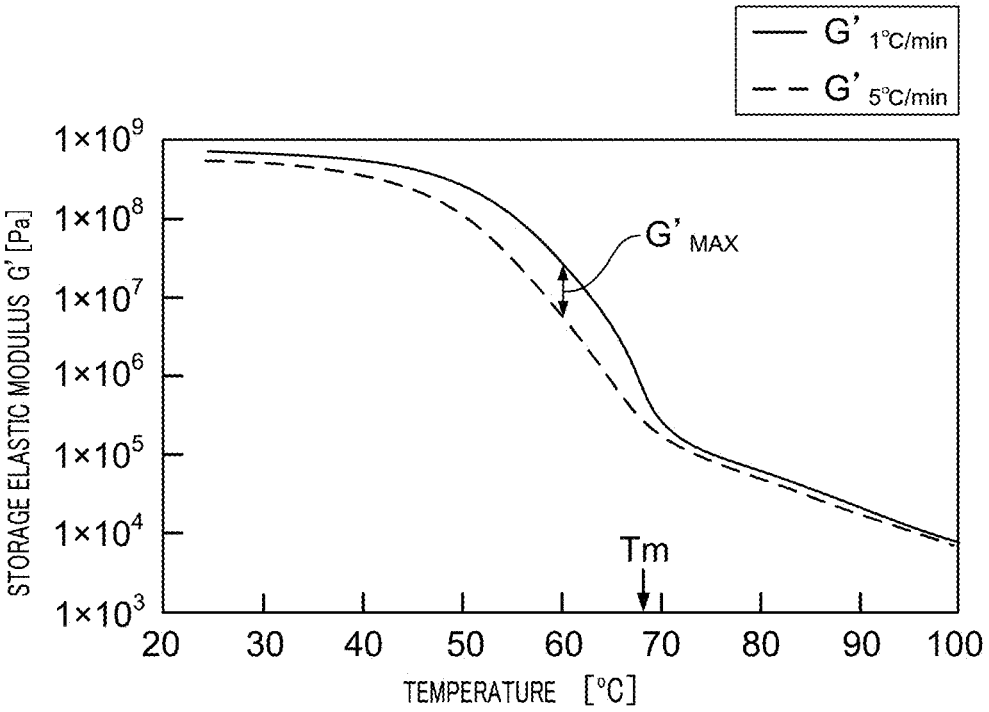
FIG. 1 illustrates a graph of one example of the storage elastic modulus of a toner according to an embodiment of the present invention.

FIG. 1 illustrates a graph of one example of the storage elastic modulus of the toner. In FIG. 1, a solid line represents $G'_{1^\circ\ C./min}$ and a dash line represents $G'_{5^\circ\ C./min}$. In the example, the Tm is slightly lower than 70° C. The $G'_{1^\circ\ C./min}$ and $G'_{5^\circ\ C./min}$ each largely vary along with melting of the toner. The degree of the variation is usually larger in $G'_{1^\circ\ C./min}$ and smaller in $G'_{5^\circ\ C./min}$ in the present invention. The difference between $G'_{1^\circ\ C./min}$ and $G'_{5^\circ\ C./min}$ usually increases and decreases in a certain temperature range. The $G'_{MAX}$ corresponds to the ratio of $G'_{1^\circ\ C./min}$ to $G'_{5^\circ\ C./min}$ in the above difference being maximum in the temperature range of Tm or lower within the certain temperature range. The difference is indicated by both arrows in FIG. 1 in the example.

The $G'_{MAX}$ shows the presence of a proper difference in storage elastic modulus between rates of temperature drop of 1° C./min and 5° C./min. The presence of such a difference is considered to indicate a proper control of the states of the amorphous resin and the crystalline resin present in the binder resin.

When the $G'_{MAX}$ value is 2.2 or more, the crystal state of the crystalline resin in the binder resin is easily controlled. For example, when the $G'_{MAX}$ is large, the cooling rate of an image after fixation can be lower to thereby control the amorphous resin and the crystalline resin in the fixed image to be incompatible. Therefore, the amorphous resin can be controlled so that the glass transition temperature is kept high in the fixed image.

In addition, the difference in elasticity depending on the rates of temperature drop is generated at a temperature equal to or lower than the melting point of the crystalline resin, thereby indicating that the crystalline resin is easily crystallized after melting of the toner. A rate of 5° C./min is so high that crystallization is hardly made, and therefore, if heat is sufficiently applied for melting, the elastic modulus is measured to a normal temperature, with being still relatively low. A rate of 1° C./min is sufficient for crystallization, and therefore the elastic modulus is measured to a normal temperature, with being relatively high. Such a difference in elastic modulus between rates of 1° C./min and 5° C./min is observed, thereby possibly indicating that the states of the amorphous resin and the crystalline resin in the toner are easily controlled.

Accordingly, if the above relationship is satisfied in the temperature condition in fixation, it is indicated that the amorphous resin and the crystalline resin in the fixed image can be controlled to be incompatible. Therefore, the glass transition temperature of the amorphous resin is still kept high in fixation, and document offset resistance of the toner is thus considered to be good. In addition, when the amorphous resin and the crystalline resin are incompatible, the crystalline resin is considered to be precipitated on the surface of the image, and on the other hand, when the melting point of the crystalline resin is sufficiently high, the melting point of a material to be precipitated on the surface is high and therefore document offset resistance is considered to be kept. From the same reason, resistance against smear to the fixed image is also considered to increase.

When the difference in storage elastic modulus between the rates of temperature drop is not sufficient, the amorphous resin and the crystalline resin are hardly controlled to be incompatible, and are considered to tend to be compatible. Accordingly, it is considered that the glass transition temperature of the amorphous resin is decreased to deteriorate document offset resistance.

When the amorphous resin and the crystalline resin is incompatible also in toner production, thermal stability and mechanical strength of the toner are easily kept, and therefore the toner is considered to be sufficient in storage property at a high temperature. On the other hand, when the amorphous resin and the crystalline resin tend to be compatible in toner production, thermal stability and mechanical strength of the toner are easily deteriorated from the same reason as above, and therefore high-temperature storage property of the toner is considered to be sometimes insufficient. The above tendencies may not be found from only thermal properties of the toner and the materials thereof, for example, measurement results of DSC.

While the storage elastic moduli $G'_{5^\circ\ C./min}$ and $G_{1^\circ\ C./min}$ are described in Examples in detail, these can be determined with a known rheometer (for example, "ARES G2" manufactured by TA instruments. Japan) by use of, as a sample, a pellet formed by pressure molding of a toner particle or a toner base particle. The measurement temperature range of the storage elastic moduli may be any range as long as substantial features (behaviors) of $G'_{5^\circ\ C./min}$ and $G'_{1^\circ\ C./min}$ in the toner are sufficiently exhibited, and may be, for example, the range from Tm−30° C. to Tm+30° C. and may be sufficiently, for example, the range from normal temperature to about 100° C. in the case of a usual electrophotographic image forming toner.

The $G'_{MAX}$ can be adjusted by, for example, the glass transition temperature Tg and the polarity of the main component of the binder resin, the amount, the polarity and the melting point of the crystalline resin, and the HB rate (the rate of the amount of an amorphous resin unit (for example, vinyl resin) in the crystalline resin) of the crystalline resin. The $G'_{MAX}$ can also be adjusted by the polarity, the melting point and the like of a release agent. The polarity of the main component of the binder resin can be adjusted depending on the type of a monomer. For example, when the monomer is a vinyl resin, the polarity can be adjusted using a monomer having a structure similar to that of the monomer of the crystalline resin, for example, when the crystalline resin is a crystalline polyester, 2-ethylhexyl acrylate (2-EHA) is used. The polarity, the melting point and the HB rate of the crystalline resin can be adjusted depending on the type of the crystalline resin. Similarly, the polarity and the melting point of the release agent can also be adjusted depending on the type of the release agent.

For example, as the Tg of the main component is increased, the $G'_{5^\circ\ C./min}$ value tends to be closer to the $G'_{1^\circ\ C./min}$ value. In addition, when the Tg of the main component is decreased, the polarity of the material is increased, or the melting point thereof is decreased, the $G'_{5^\circ\ C./min}$ value tends to be more away from the $G'_{1^\circ\ C./min}$ value, and when a lamella structure is taken as a crystal structure, crystallization is more easily controlled and the $G'_{MAX}$ value also tends to increase.

The Tm is the melting point of the toner base particle, determined depending on a crystalline material in the toner base particle. Examples of the crystalline material include a crystalline resin and a release agent. When the toner base particle includes two or more of the crystalline materials, the Tm is usually a higher melting point among two or more of the melting points of the crystalline materials. While the Tm is described in Examples in detail, it can be measured with a known DSC apparatus such as "DIAMOND DSC" manufactured by PerkinElmer Co., Ltd. by use of, as a sample, the toner particle or the toner base particle.

The $G'_{5^\circ\ C./min}$ is preferably equal to or less than $G'_{1^\circ\ C./min}$ at a temperature equal to or lower than Tm because crystallization can be controlled as described above in a broader temperature range.

A ratio of $G'_{1° C./min}$ to $G_{5° C./min}$ of 1 or more and 1.4 or less at a temperature higher than Tm represents a ratio of one storage elastic modulus in sufficient heat application to other storage elastic modulus, among storage elastic moduli at a temperature equal to or higher than the melting point of the crystalline material of the toner, of 1 to 1.4. Thus, the crystalline resin is considered to be sufficiently molten completely in fixation, and such a ratio is preferable from the viewpoint that low-temperature fixability is enhanced because low-temperature fixability of the toner is achieved by not only selection of the crystalline resin, but also a reduction in elasticity of the toner.

In consideration of ease of control of the crystal state in a fixing process of an actual image forming apparatus, the $G'_{MAX}$ is preferably 3.6 or more and 6.2 or less. If the $G'_{MAX}$ exceeds 6.2, the variation width between $G'_{5° C./min}$ and $G'_{1° C./min}$ is increased to cause control for incompatibilization to be more dominant, making it difficult to realize given performances in the actual apparatus.

The Tm is preferably 65° C. or higher in terms of high-temperature storage property and document offset resistance, and is preferably 90° C. or lower in terms of low-temperature fixability.

The toner may be a one-component developer or a two-component developer as long as the $G'_{MAX}$ is satisfied. The one-component developer is configured from only a toner particle, and the two-component developer is configured by a toner particle and a carrier particle. The toner particle is configured by a toner base particle and an external additive attached to the surface thereof. The toner can be prepared by using a known compound as a toner material according to an ordinary method.

The toner base particle contains a binder resin and a release agent. The binder resin includes the crystalline resin, and usually further includes an amorphous resin.

The crystalline resin refers to a resin not exhibiting a stepwise endothermic change but exhibiting a distinct endothermic peak in DSC of the crystalline resin or the toner particle. The distinct endothermic peak specifically means a peak in which the half-value width of the endothermic peak in DSC measured at a rate of temperature rise of 10° C./min is within 15° C.

The crystalline resin may be of one or more. The melting point Tmc of the crystalline resin is preferably 60° C. or higher and 85° C. or lower from the viewpoint that sufficient low-temperature fixability and high-temperature storage property are achieved.

The melting point can be measured by DSC. Specifically, 0.5 mg of a crystalline resin sample is loaded into an aluminum pan "KITNO.B0143013", the pan is set to a sample holder of a thermal analysis apparatus "DIAMOND DSC" (manufactured by PerkinElmer Co., Ltd.), and the temperature is varied in the order of heating, cooling and heating. The temperature is raised from room temperature (25° C.) to 150° C. at a rate of temperature rise of 10° C./min and kept at 150° C. for 5 minutes in first and second heatings, and the temperature is dropped from 150° C. to 0° C. at a rate of temperature drop of 10° C./min and kept at 0° C. for 5 minutes in cooling. The temperature at the peak top of the endothermic peak on the endothermic curve obtained in second heating is adopted as the melting point (Tmc).

The content of the crystalline resin in the toner base particle is preferably 2 to 20 mass %, more preferably 5 to 15 mass % from the viewpoint that low-temperature fixability is good. If the content is less than 2 mass %, a sufficient plasticization effect is not achieved, and low-temperature fixability may be insufficient. If the content exceeds 20 mass %, thermal stability as the toner or stability against a physical stress may be insufficient. When the content is within the preferable range or more preferable range, for example, the configuration of the amorphous resin and a proper production method are selected to thereby more facilitate control to a preferable viscoelasticity.

The crystalline resin is preferably a crystalline polyester in terms of thermal properties related to low-temperature fixability.

It is preferable in terms of low-temperature fixability and stable development of gloss in a final image that the weight average molecular weight (Mw) of the crystalline polyester be in the range from 5,000 to 50,000 and the number average molecular weight (Mn) thereof be in the range from 2,000 to 10,000. Mw and Mn can be determined from the molecular weight distribution measured by gel permeation chromatography (GPC).

A specimen is added into tetrahydrofuran (THF) so that the concentration is 1 mg/mL, and the resultant is subjected to a dispersing treatment with an ultrasonic dispersing machine at room temperature for 5 minutes, and thereafter is treated by a membrane filter with a pore size of 0.2 μm to prepare a specimen liquid. A GPC apparatus HLC-8120GPC (manufactured by Tosoh Corporation) and a column "TSK guard column+TSKgel SuperHZ-m3 in series" (manufactured by Tosoh Corporation) are used, and THF as a carrier solvent is allowed to flow at a flow rate of 0.2 mL/min with the column temperature being kept at 40° C. The carrier solvent and 10 μL of the specimen liquid prepared are injected into the GPC apparatus, and the specimen is detected with a refractive index detector (RI detector). The molecular weight distribution of the specimen is then calculated using a calibration curve obtained by measurement at 10 points with respect to a monodisperse polystyrene standard particle.

The crystalline polyester is obtained by a polycondensation reaction of a di- or higher-valent carboxylic acid (polyvalent carboxylic acid) and a di- or higher-hydric alcohol (polyhydric alcohol).

Examples of the polyvalent carboxylic acid include a dicarboxylic acid. The dicarboxylic acid may be of one or more, is preferably an aliphatic dicarboxylic acid, and may further include an aromatic dicarboxylic acid. The aliphatic dicarboxylic acid is preferably straight from the viewpoint that crystallinity of the crystalline polyester is enhanced.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid (dodecanedioic acid), 1,13-tridecanedicarboxylic acid, 1,14-tetradecanedicarboxylic acid, 1,16-hexadecanedicarboxylic acid, 1,18-octadecanedicarboxylic acid, and lower alkyl esters and acid anhydrides thereof. Among them, $C_{6\ to\ 16}$ aliphatic dicarboxylic acids are preferable, and $C_{10\ to\ 14}$ aliphatic dicarboxylic acids are more preferable from the viewpoint that the effect of simultaneously satisfying low-temperature fixability and transfer property is easily achieved.

Examples of the aromatic dicarboxylic acid include terephthalic acid, isophthalic acid, orthophthalic acid, t-butylisophthalic acid, 2,6-naphthalenedicarboxylic acid and 4,4'-biphenyldicarboxylic acid. Among them, terephthalic acid, isophthalic acid or t-butylisophthalic acid is preferable in terms of availability and ease of emulsification.

The content of the structural unit derived from the aliphatic dicarboxylic acid relative to the structural unit derived from the dicarboxylic acid in the crystalline polyester is preferably 50% by mole or more, more preferably 70% by mole or more, further preferably 80% by mole or more, particularly preferably 100% by mole from the viewpoint that crystallinity of the crystalline polyester is sufficiently ensured.

Examples of the polyhydric alcohol component include a diol. The diol may be of one or more, is preferably an aliphatic diol, and may further include other diol. The aliphatic diol is preferably straight from the viewpoint that crystallinity of the crystalline polyester is enhanced.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. Among them, $C_{2\ to\ 120}$ aliphatic diols are preferable, and $C_{4\ to\ 6}$ aliphatic diols are more preferable from the viewpoint that the effect of simultaneously satisfying low-temperature fixability and transfer property is easily achieved.

Examples of other diol include a diol having a double bond and a diol having a sulfonic acid group. Specifically, examples of the diol having a double bond include 2-butene-1,4-diol, 3-butene-1,6-diol and 4-butene-1,8-diol.

The content of the structural unit derived from the aliphatic diol relative to the structural unit derived from the diol in the crystalline polyester is preferably 50% by mole or more, more preferably 70% by mole or more, further preferably 80% by mole or more, particularly preferably 100% by mole from the viewpoint that low-temperature fixability of the toner and glossiness of an image to be finally formed are enhanced.

The ratio of the diol to the dicarboxylic acid in the monomer of the crystalline polyester is preferably in the range from 2.0/1.0 to 1.0/2.0, more preferably in the range from 1.5/1.0 to 1.0/1.5, particularly preferably in the range from 1.3/1.0 to 1.0/1.3 as the equivalent ratio [OH]/[COOH] of the hydroxyl group [OH] of the diol to the carboxy group [COOH] of the dicarboxylic acid.

The monomer that constitutes the crystalline polyester preferably contains 50 mass % or more, more preferably 80 mass % or more of a straight aliphatic monomer. When an aromatic monomer is used, the melting point of the crystalline polyester significantly tends to be higher, and when a branched aliphatic monomer is used, crystallinity significantly tends to be lower. Accordingly, the straight aliphatic monomer is preferably used for the monomer. The straight aliphatic monomer in the toner is preferably used in an amount of 50 mass % or more, more preferably 80 mass % or more from the viewpoint that crystallinity of the crystalline polyester is kept.

The crystalline polyester can be synthesized by polycondensation (esterification) of the polyvalent carboxylic acid and the polyhydric alcohol by use of a known esterification catalyst.

The catalyst that can be used for synthesis of the crystalline polyester may be of one or more, and examples thereof include a compound of any alkali metal such as sodium and lithium; a compound containing any Group 2 element such as magnesium and calcium; a compound of any metal such as aluminum, zinc, manganese, antimony, titanium, tin, zirconium and germanium; a phosphorous acid compound; a phosphoric acid compound; and an amine compound.

Specifically, examples of the tin compound include dibutyltin oxide, tin octylate, tin dioctylate, and salts thereof. Examples of the titanium compound include titanium alkoxides such as tetra-n-butyl titanate, tetraisopropyl titanate, tetramethyl titanate and tetrastearyl titanate; titanium acylates such as polyhydroxy titanium stearate; and titanium chelates such as titanium tetraacetylacetonate, titanium lactate and titanium triethanolaminate. Examples of the germanium compound include germanium dioxide, and examples of the aluminum compound include oxides such as aluminum polyhydroxide, and aluminum alkoxide and tributyl aluminate.

The polymerization temperature of the crystalline polyester is preferably in the range from 150 to 250° C. The polymerization time is preferably in the range from 0.5 to 10 hours. In polymerization, the reaction system may be, if necessary, under reduced pressure.

The amorphous resin is a resin not having the above crystallinity. For example, the amorphous resin is a resin having no melting point and having a relatively high glass transition temperature (Tg) in differential scanning calorimetry (DSC) of the amorphous resin or the toner particle.

When the glass transition temperatures in first and second temperature rise processes in DSC are defined as Tg1 and Tg2, respectively, the Tg1 of the amorphous resin is preferably in the range from 35 to 80° C., particularly preferably in the range from 45 to 65° C., and the Tg2 of the amorphous resin is preferably in the range from 20 to 70° C., particularly preferably in the range from 30 to 55° C.

The glass transition temperatures can be measured according to the method (DSC method) prescribed in ASTM (American Society for Testing and Materials Standard) D3418-82. In the measurement, a DSC-7 differential scanning calorimeter (manufactured by PerkinElmer Co., Ltd.), a TACT/DX thermal analysis apparatus controller (manufactured by PerkinElmer Co., Ltd.), and the like can be used.

The amorphous resin may be of one or more. Examples of the amorphous resin include a vinyl resin, a urethane resin, a urea resin, and an amorphous polyester such as a styrene-acrylic modified polyester. Among them, a vinyl resin is preferable from the viewpoint that thermoplasticity is easily controlled.

The vinyl resin is, for example, a polymer of a vinyl compound, and examples thereof include an acrylic acid ester resin, a styrene-acrylic acid ester resin and an ethylene-vinyl acetate resin. Among them, a styrene-acrylic acid ester resin (styrene acrylic resin) is preferable in terms of plasticity in thermal fixation.

The styrene acrylic resin is formed by addition polymerization of at least a styrene monomer and a (meth)acrylic acid ester monomer. The styrene monomer includes, in addition to styrene represented by a structural formula $CH_2{=}CH{-}C_6H_5$, a styrene derivative having known side chain and functional group in a styrene structure.

The (meth)acrylic acid ester monomer includes, in addition to an acrylic acid ester and a methacrylic acid ester represented by $CH(R_1){=}CHCOOR_2$ ($R_1$ represents a hydrogen atom or a methyl group, and $R_2$ represents a $C_{1\ to\ 24}$ alkyl group), an acrylic acid ester derivative and a methacrylic acid ester derivative each having known side chain and functional group in each ester structure.

Examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene.

Examples of the (meth)acrylic acid ester monomer include acrylic acid ester monomers such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; and methacrylic acid esters such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate.

In the present specification, the "(meth)acrylic acid ester monomer" is a collective term of an "acrylic acid ester monomer" and a "methacrylic acid ester monomer", and means one or both thereof. For example, "methyl (meth) acrylate" means one or both of "methyl acrylate" and "methyl methacrylate".

The (meth)acrylic acid ester monomer may be of one or more. For example, the styrene monomer and two or more of the acrylic acid ester monomers can be used to form a copolymer, the styrene monomer and two or more of the methacrylic acid ester monomers can be used to form a copolymer, and the styrene monomer, and the acrylic acid ester monomer and the methacrylic acid ester monomer can be used in combination to form a copolymer.

The content of the structural unit derived from the styrene monomer in the amorphous resin is preferably in the range from 40 to 90 mass % from the viewpoint that plasticity of the amorphous resin is controlled. The content of the structural unit derived from the (meth)acrylic acid ester monomer in the amorphous resin is preferably in the range from 10 to 60 mass %.

The amorphous resin may further contain a structural unit derived from a monomer other than the styrene monomer and the (meth)acrylic acid ester monomer. Such other monomer is preferably a compound that can form an ester bond with the hydroxyl group (—OH) derived from the polyhydric alcohol or the carboxy group (—COOH) derived from the polyvalent carboxylic acid. That is, the amorphous resin is preferably a polymer obtained by polymerization of a compound (bifunctional compound) that can be subjected to addition polymerization with the styrene monomer and the (meth)acrylic acid ester monomer and that has a carboxy group or a hydroxy group.

Examples of the bifunctional compound include compounds having a carboxy group, such as acrylic acid, methacrylic acid, maleic acid, itaconic acid, cinnamic acid, fumaric acid, maleic acid monoalkyl ester and itaconic acid monoalkyl ester; and compounds having a hydroxy group, such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate and polyethylene glycol mono(meth)acrylate.

The content of the structural unit derived from the bifunctional compound in the amorphous resin is preferably in the range from 0.5 to 20 mass %.

The styrene acrylic resin can be synthesized by a method of polymerizing a monomer by use of a known oil-soluble or water-soluble polymerization initiator. Examples of the oil-soluble polymerization initiator include an azo or diazo polymerization initiator and a peroxide polymerization initiator.

Examples of the azo or diazo polymerization initiator include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile.

Examples of the peroxide polymerization initiator include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane and tris-(t-butylperoxy)triazine.

When the resin particle of the styrene acrylic resin is synthesized by an emulsion polymerization, a water-soluble radical polymerization initiator can be used as the polymerization initiator. Examples of the water-soluble polymerization initiator include persulfates such as potassium persulfate and ammonium persulfate, an azobisaminodipropane acetic acid salt, azobiscyanovaleric acid and a salt thereof, and hydrogen peroxide.

The weight average molecular weight (Mw) of the amorphous resin is preferably 5,000 to 150,000, more preferably 10,000 to 70,000 from the viewpoint that plasticity of the amorphous resin is easily controlled.

The structure and the constitutional monomer of the crystalline resin have effects on the degree of crystallization and the amount of heat of fusion of the crystalline resin. The crystalline resin is preferably a hybrid crystalline polyester (hereinafter, also simply referred to as "hybrid resin") from the viewpoint that the degree of crystallization of the crystalline resin is adjusted within a preferable range for fixation. The hybrid resin may be of one or more. The hybrid resin may be replaced with the total amount of the crystalline polyester, or may be replaced with a part of the crystalline polyester (used in combination).

The hybrid resin is a resin in which a crystalline polyester unit segment and an amorphous resin unit segment are chemically bound. The crystalline polyester unit segment means a portion derived from the crystalline polyester. That is, the segment means a molecular chain having the same chemical structure as the molecular chain forming the crystalline polyester. The amorphous resin unit segment means a portion derived from the amorphous resin. That is, the segment means a molecular chain having the same chemical structure as the molecular chain forming the amorphous resin.

The Mw of the hybrid resin is preferably in the range from 5,000 to 100,000, more preferably in the range from 7,000 to 50,000, particularly preferably in the range from 8,000 to 20,000 from the viewpoint that sufficient low-temperature fixability and excellent long-term storage stability can be simultaneously certainly satisfied. The Mw of the hybrid resin can be 100,000 or less to thereby impart sufficient low-temperature fixability. On the other hand, the Mw of the hybrid resin can be 5,000 or more to thereby inhibit compatibilization of the hybrid resin and the amorphous resin from excessively progressing in toner storage, effectively suppressing an image defect due to toner fusion.

The crystalline polyester unit segment may be, for example, a resin having a structure in which other component is copolymerized with the main chain of the crystalline polyester unit segment, or a resin having a structure in which the crystalline polyester unit segment is copolymerized with the main chain of other component. The crystalline polyester unit segment can be synthesized from the polyvalent carboxylic acid and the polyhydric alcohol in the same manner as in the crystalline polyester.

The content of the crystalline polyester unit segment in the hybrid resin is preferably 80 mass % or more and less than 98 mass %, more preferably 90 mass % or more and less than 95 mass %, further preferably 91 mass % or more and less than 93 mass % from the viewpoint that sufficient crystallinity is imparted to the hybrid resin. The constituent components of the respective unit segments in the hybrid resin (or in the toner), and the contents of the constituent components can be identified with a known analysis method such as nuclear magnetic resonance (NMR) and methylation pyrolysis gas chromatography/mass spectrometry (P-GC/MS).

The crystalline polyester unit segment preferably further includes, as a monomer, a monomer having an unsaturated bond from the viewpoint that a chemical bond moiety with the amorphous resin unit segment is introduced into the segment. The monomer having an unsaturated bond is, for example, a polyhydric alcohol having a double bond, and examples thereof include polyvalent carboxylic acids having a double bond, such as methylenesuccinic acid, fumaric acid, maleic acid, 3-hexenedioic acid and 3-octenedioic acid; and 2-butene-1,4-diol, 3-butene-1,6-diol and 4-butene-1,8-diol. The content of the structural unit derived from the monomer having an unsaturated bond, in the crystalline polyester unit segment, is preferably in the range from 0.5 to 20 mass %.

The hybrid resin may be a block copolymer or a graft copolymer. The hybrid resin is preferably a graft copolymer from the viewpoints that orientation of the crystalline polyester unit segment is easily controlled and sufficient crystallinity is imparted to the hybrid resin, more preferably a graft copolymer in which the crystalline polyester unit segment is grafted with the amorphous resin unit segment as a main chain. That is, the hybrid resin is preferably a graft copolymer having the amorphous resin unit segment as a main chain and the crystalline polyester unit segment as a side chain.

A functional group such as a sulfonic acid group, a carboxy group or a urethane group may be further introduced to the hybrid resin. The functional group may be introduced into the crystalline polyester unit segment or the amorphous resin unit segment.

The amorphous resin unit segment enhances the affinity of the amorphous resin forming the binder resin with the hybrid resin. Thus, the hybrid resin is more easily incorporated into the amorphous resin, resulting in a more enhancement in charging uniformity of the toner. The constituent component of the amorphous resin unit segment in the hybrid resin (or in the toner), and the content of the constituent component can be identified with a known analysis method such as NMR and methylation P-GC/MS.

The glass transition temperature (Tg1) of the amorphous resin unit segment in a first temperature rise process of DSC is preferably in the range from 30 to 80° C., more preferably in the range from 40 to 65° C., as in the case of the amorphous resin. The glass transition temperature (Tg1) can be measured by the above method.

The amorphous resin unit segment is preferably configured from the same type of the resin as the amorphous resin included in the binder resin from the viewpoints that the affinity with the binder resin is enhanced and charging uniformity of the toner is enhanced. Such a mode is adopted to thereby more enhance the affinity of the hybrid resin with the amorphous resin, and the "same type" means that each resin has a common characteristic chemical bond in a repeating unit.

The "characteristic chemical bond" is according to "polymer classification" described in the material database (http://polymer.nims.go.jp/PoLyInfo/guide/jp/term_polymer.html) of National Institute for Materials Science (NIMS). That is, the "characteristic chemical bond" refers to any chemical bond that can form any polymer classified to 22 polymers in total of polyacryl, polyamide, polyacid anhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea, polyvinyl and the like.

When the resin is a copolymer, the "same type of the resin" means that, when the monomer having a chemical bond serves as a structural unit in the chemical structure of a plurality of monomers constituting the copolymer, each resin has a common characteristic chemical bond. Accordingly, even when resins per se exhibit mutually different properties and/or have mutually different molar component rates of the monomers constituting the copolymer, these are assumed to be classified to the same type of the resin as long as a common characteristic chemical bond is included therein.

For example, a resin (or a resin unit segment) to be formed by styrene, butyl acrylate and acrylic acid, and a resin (or a resin unit segment) to be formed by styrene, butyl acrylate and methacrylic acid have at least a chemical bond that can form polyacryl, and these resins are classified to the same type of the resin. By way of another example, a resin (or a resin unit segment) to be formed by styrene, butyl acrylate and acrylic acid, and a resin (or a resin unit segment) to be formed by styrene, butyl acrylate, acrylic acid, terephthalic acid and fumaric acid have at least a chemical bond that can form polyacryl, as a mutually common chemical bond. Accordingly, these resins are classified to the same type of the resin.

Examples of the amorphous resin unit segment include a vinyl resin unit, a urethane resin unit and a urea resin unit. Among them, a vinyl resin unit is preferable from the viewpoint that thermoplasticity is easily controlled. Such a vinyl resin unit can be synthesized in the same manner as in the above vinyl resin.

The content of the structural unit derived from the styrene monomer in the amorphous resin unit segment is preferably in the range from 40 to 90 mass % from the viewpoint that plasticity of the hybrid resin is easily controlled. From the same viewpoint, the content of the structural unit derived from the (meth)acrylic acid ester monomer in the amorphous resin unit segment is preferably in the range from 10 to 60 mass %.

The amorphous resin unit segment preferably further contains, as a monomer, the bifunctional compound from the viewpoint that a chemical bond moiety with the crystalline polyester unit segment is introduced into the amorphous resin unit segment. The content of the structural unit derived from the bifunctional compound in the amorphous resin unit segment is preferably in the range from 0.5 to 20 mass %.

The content of the amorphous resin unit segment in the hybrid resin is preferably 3 mass % or more and less than 15 mass %, more preferably 5 mass % or more and less than 10 mass %, further preferably 7 mass % or more and less than 9 mass % from the viewpoint that sufficient crystallinity is imparted to the hybrid resin.

The hybrid resin can be produced by, for example, first to third production methods described below.

The first production method is a method in which a polymerization reaction for synthesis of the crystalline polyester unit segment is performed in the presence of the amorphous resin unit segment synthesized in advance, to produce the hybrid resin.

In this method, first, the monomer for constituting the amorphous resin unit segment (preferably vinyl monomer such as styrene monomer and (meth)acrylic acid ester monomer) is subjected to an addition reaction to synthesize the amorphous resin unit segment. Next, a polymerization reaction of the polyvalent carboxylic acid and the polyhydric alcohol is performed in the presence of the amorphous resin unit segment, to synthesize the crystalline polyester unit segment. The polyvalent carboxylic acid and the polyhydric alcohol are here subjected to a condensation reaction, and also the polyvalent carboxylic acid or the polyhydric alcohol is subjected to an addition reaction to the amorphous resin unit segment, to thereby synthesize the hybrid resin.

In the first method, a moiety at which the crystalline polyester unit segment and the amorphous resin unit segment can react with each other is preferably incorporated in the crystalline polyester unit segment or the amorphous resin unit segment. Specifically, the bifunctional compound is also used, in addition to the monomer for constituting the amorphous resin unit segment, in synthesis of the amorphous resin unit segment. The bifunctional compound reacts with a carboxy group or a hydroxy group in the crystalline polyester unit segment, thereby allowing the crystalline polyester unit segment to be bound to the amorphous resin unit segment chemically and quantitatively. In synthesis of the crystalline polyester unit segment, the compound having an unsaturated bond may also be further contained in the monomer.

The first method can synthesize a hybrid resin having a structure (graft structure) where the crystalline polyester unit segment is molecularly bound to the amorphous resin unit segment.

The second production method is a method in which each of the crystalline polyester unit segment and the amorphous resin unit segment is formed in advance and these are bound to produce the hybrid resin.

In this method, first, the polyvalent carboxylic acid and the polyhydric alcohol are subjected to a condensation reaction to synthesize the crystalline polyester unit segment. The monomer for constituting the amorphous resin unit segment is subjected to an addition polymerization to synthesize the amorphous resin unit segment in a reaction system other than the reaction system for synthesis of the crystalline polyester unit segment. A moiety at which the crystalline polyester unit segment and the amorphous resin unit segment can react with each other is here preferably incorporated into one or both of the crystalline polyester unit segment and the amorphous resin unit segment, as described above.

Next, the crystalline polyester unit segment and the amorphous resin unit segment synthesized can react with each other to thereby synthesize a hybrid resin having a structure in which the crystalline polyester unit segment and the amorphous resin unit segment are molecularly bound.

When the reactive moiety is not incorporated into either the crystalline polyester unit segment or the amorphous resin unit segment, a method can be adopted in which a compound having a moiety that can be bound to both of the crystalline polyester unit segment and the amorphous resin unit segment is charged in the coexistence system of the crystalline polyester unit segment and the amorphous resin unit segment. Thus, the compound can allow a hybrid resin having a structure, where the crystalline polyester unit segment and the amorphous resin unit segment are molecularly bound, to be synthesized.

The third production method is a method in which a polymerization reaction for synthesis of the amorphous resin unit segment is performed in the presence of the crystalline polyester unit segment to produce the hybrid resin.

In this method, first, a condensation reaction of the polyvalent carboxylic acid and the polyhydric alcohol is performed for polymerization to synthesize the crystalline polyester unit segment in advance. Next, the monomer for constituting the amorphous resin unit segment is subjected to a polymerization reaction in the presence of the crystalline polyester unit segment to synthesize the amorphous resin unit segment. A moiety at which the crystalline polyester unit segment and the amorphous resin unit segment can react with each other is preferably incorporated to the crystalline polyester unit segment or the amorphous resin unit segment as in the first production method.

The method can synthesize a hybrid resin having a structure (graft structure) in which the amorphous resin unit segment is molecularly bound to the crystalline polyester unit segment.

Among the first to third production methods, the first production method is preferable because a hybrid resin having a structure in which a crystalline polyester chain is grafted to an amorphous resin chain is easily synthesized and a production process can be simplified. In the first production method, the amorphous resin unit segment is formed in advance and the crystalline polyester unit segment is then bound thereto, and therefore orientation of the crystalline polyester unit segment is easily made uniform. Accordingly, the first production method is preferable from the viewpoint that a hybrid resin suitable for the toner is certainly synthesized.

As the release agent, a known release agent can be used. The release agent may be of one or more. Examples of the release agent include polyolefin waxes such as polyethylene wax and polypropylene wax, branched hydrocarbon waxes such as microcrystalline wax; long chain hydrocarbon waxes such as paraffin wax and Sasolwax; dialkyl ketone waxes such as distearyl ketone, ester waxes such as carnauba wax, montan wax, behenic acid/behenate, trimethylolpropane tribehenate, pentaerythritol tetrabehenate, pentaerythritol diacetate dibehenate, glycerin tribehenate, 1,18-octadecanediol distearate, tristearyl trimellitate and distearyl maleate, and amide waxes such as ethylenediamine behenylamide and tristearyl trimellitate amide.

The melting point of the release agent is preferably in the range from 40 to 160° C., more preferably in the range from 50 to 120° C. from the viewpoints that high-temperature storage property of the toner is sufficiently ensured and cold offset in fixation at a low temperature is inhibited from occurring, to enhance stability of toner image forming. The content of the release agent in the toner is preferably in the range from 1 to 30 mass %, more preferably in the range from 5 to 20 mass %.

The content of a release agent in a black toner described later is preferably lower than that in a chromatic toner by 5 to 20 mass % from the viewpoint that a good relationship between the exothermic peak temperature of the black toner and the exothermic peak temperature of the chromatic toner, as described above, is achieved.

The toner may further contain any component other than the crystalline resin, the amorphous resin and the release agent as long as at least one of the effects of the present embodiment is exerted. For example, such other component that may be contained in the toner base particle includes a colorant and a charge control agent.

The colorant may be of one or more. Typical examples of the colorant include respective magenta, yellow, cyan and black colorants.

Examples of the magenta colorant include C.I. Pigment Reds 2, 3, 5, 6, 7, 15, 16, 48:1, 53:1, 57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238 and 269.

Examples of the yellow colorant include C.I. Pigment Oranges 31, 43, C.I. Pigment Yellows 12, 14, 15, 17, 74, 83, 93, 94, 138, 155, 162, 180 and 185.

Examples of the cyan colorant include C.I. Pigment Blues 2, 3, 15, 15:2, 15:3, 15:4, 16, 17, 60, 62 and 66, and C.I. Pigment Green 7.

Examples of the black colorant include carbon black and a magnetic material particle. Examples of carbon black include channel black, furnace black, acetylene black, thermal black and lampblack. Examples of the magnetic material of the magnetic material particle include ferromagnetic metals such as iron, nickel and cobalt; alloys including such metals, ferromagnetic metal compounds such as ferrite and magnetite; chromium dioxide; and alloys not including any ferromagnetic metal but exhibiting ferromagnetic property by a heat treatment. Examples of the alloy exhibiting ferromagnetic property by a heat treatment include Heusler alloys such as manganese-copper-aluminum and manganese-copper-tin.

The content of the colorant in the toner base particle can be appropriately and independently determined, and is, for example, preferably 1 to 30 mass %, more preferably 2 to 20 mass % from the viewpoint that color reproducibility of an image is ensured. The size of the particle of the colorant is, for example, preferably in the range from 10 to 1,000 nm, more preferably in the range from 50 to 500 nm, further preferably in the range from 80 to 300 nm as a volume average particle size. The volume average particle size may be a catalog value, and the volume average particle size (median size on a volume basis) of the colorant can be measured by "UPA-150" (manufactured by MicrotracBEL Corp.).

As the charge control agent, a known charge control agent can be used, and examples include a nigrosine dye, a metal salt of naphthenic acid or a higher fatty acid, an alkoxylated amine, a quaternary ammonium salt compound, an azo metal complex and a salicylic acid metal salt. The content of the charge control agent in the toner is usually in the range from 0.1 to 10 parts by mass, preferably in the range from 0.5 to 5 mass % relative to 100 parts by mass of the binder resin. The size of the particle of the charge control agent is, for example, in the range from 10 to 1,000 nm, preferably in the range from 50 to 500 nm, more preferably in the range from 80 to 300 nm as a number average primary particle size.

The external additive may be of one or more. The external additive is attached to the surface of the toner base particle to enhance charging performance, flow ability or cleaning property of the toner. Examples of the external additive include an inorganic fine particle, an organic fine particle and a lubricant.

Examples of the inorganic compound in the inorganic fine particle include silica, titania, alumina and strontium titanate. The inorganic fine particle may be, if necessary, subjected to a hydrophobic treatment with a surface treating agent such as a known silane coupling agent or a silicone oil. The size of the inorganic fine particle is preferably in the range from 20 to 500 nm, more preferably in the range from 70 to 300 nm as a number average primary particle size.

As the organic fine particle, an organic fine particle of a homopolymer of styrene or methyl methacrylate, or a copolymer thereof can be used. The size of the organic fine particle is about 10 to 2,000 nm as a number average primary particle size, and the shape of the particle is, for example, a spherical shape.

The lubricant is used for the purpose of further enhancing cleaning property and transfer property. Examples of the lubricant include a metal salt of a higher fatty acid, more specifically include zinc, aluminum, copper, magnesium and calcium salts of stearic acid; zinc, manganese, iron, copper and magnesium salts of oleic acid; zinc, copper, magnesium and calcium salt of palmitic acid; zinc and calcium salts of linoleic acid; and zinc and calcium salts of ricinoleic acid. The size of the lubricant is preferably in the range from 0.3 to 20 μm, more preferably in the range from 0.5 to 10 μm as a median size on a volume basis (volume average particle size).

The median size on a volume basis of the lubricant can be determined according to JIS Z8825-1 (2013) that is specifically as follows.

A laser diffraction/scattering type particle size distribution analyzer "LA-920" (manufactured by Horiba, Ltd.) is used as a measurement apparatus. Dedicated software "HORIBA LA-920 for Windows (registered trademark) WET (LA-920) Ver.2.02" attached to LA-920 is used for setting of measurement conditions and analysis of measurement data. Ion-exchange water from which solid impurities are removed in advance is used as a measurement solvent.

The measurement procedure is according to the following (1) to (11).

(1) A batch type cell holder is mounted on LA-920.

(2) A predetermined amount of ion-exchange water is placed in a batch type cell, and the batch type cell is set in the batch type cell holder.

(3) The content of the batch type cell is stirred with a dedicated stirrer chip.

(4) The "refractive index" button on the "display condition setting" screen is pushed and file "110A000I" (relative refractive index: 1.10) is selected.

(5) The particle size basis is set to "volume basis" on the "display condition setting" screen.

(6) After a warming-up operation is performed for 1 hour or more, adjustment and fine adjustment of the optical axis, and blank measurement are performed.

(7) About 60 mL of ion-exchange water is placed in a 100-mL flat-bottomed glass beaker. About 0.3 mL of a diluted solution obtained by diluting "CONTAMION N" (a 10 mass % aqueous solution of a neutral detergent for washing a precision measuring unit, including a non-ionic surfactant, an anionic surfactant and an organic builder and having a pH of 7, produced by Wako Pure Chemical Industries, Ltd.) with ion-exchange water about 3 mass-fold is added thereinto as a dispersant.

(8) An ultrasonic disperser "ULTRASONIC DISPENSION SYSTEM TETORA 150" (manufactured by Nikkaki Bios Co., Ltd.) is prepared in which two oscillators each having an oscillatory frequency of 50 kHz are built so as to be out of phase by 1800 and which has an electrical output of 120 W. About 3.3 L of ion-exchange water is charged into a water tank of the ultrasonic disperser, and about 2 mL of CONTAMION N is added into the water tank.

(9) The beaker in (7) is set in the beaker fixing hole of the ultrasonic disperser, and the ultrasonic disperser is operated. The position of the beaker is adjusted so that the liquid level of the aqueous solution in the beaker resonates to the maximum extent.

(10) While the aqueous solution in the beaker in (9) is irradiated with an ultrasonic wave, about 1 mg of lubricant particles are added in small portions into the aqueous solution in the beaker and dispersed. An ultrasonic dispersing treatment is continued for an additional 60 seconds. Here, the lubricant particles may be formed into a mass and the mass may float on the liquid surface, and in such a case, the beaker is vibrated and moved to thereby allow the mass to be settled in water, and ultrasonic dispersion is then performed for 60 seconds. In such ultrasonic dispersion, the temperature of water in the water tank is appropriately adjusted so as to be 10° C. or higher and 40° C. or lower.

(11) The aqueous solution prepared in (10) in which the lubricant particles are dispersed is added immediately in small portions to the batch type cell with careful attention so that no air bubble is incorporated, and the concentration of the dispersion liquid is adjusted so that the transmittance of light from a tungsten lamp is 90% to 95%. The particle size distribution is measured. The 50% cumulative size is determined based on the resulting particle size distribution data on a volume basis, and defined as the median size of the lubricant on a volume basis.

The particle size of the external additive may be a catalog value or a measured value. The volume average particle size of the external additive can be determined by observing 100 primary particles with respect to the external additive on the toner base particle by a scanning electron microscope (SEM) apparatus, measuring the longest size and the shortest size of the external additive by image analysis of the primary particles observed, and determining the equivalent spherical size from the median value of the longest size and the shortest size to provide the size (D50v) at a cumulative frequency of 50% of the equivalent spherical size. The volume average particle size of the external additive can be adjusted by, for example, pulverization and classification of a coarse particle, and mixing of classified particles.

The content of the external additive in the toner particle is preferably in the range from 0.1 to 10.0 parts by mass relative to 100 parts by mass of the toner particle. The external additive can be added to the toner base particle with known various mixing apparatuses such as a Turbula mixer, a Henschel mixer, a Nauta mixer and a V-type mixing machine.

The carrier particle includes a magnetic particle. Examples of the magnetic material of the magnetic particle include metals such as iron, ferrite and magnetite; alloys of such a metal with any metal such as aluminum and lead; and a conventionally known material. Among them, the magnetic particle is preferably a ferrite particle.

The carrier particle may be a resin-coated carrier particle having the magnetic particle and a resin layer with which the surface of the magnetic particle is coated, or may be a magnetic material-dispersed carrier particle in which a fine particle of the magnetic material is dispersed in a resin particle. Examples of the resin with which the resin-coated carrier particle is coated include an olefin resin, a cyclohexyl methacrylate-methyl methacrylate copolymer, a styrene resin, a styrene acrylic resin, a silicone resin, an ester resin and a fluororesin. Examples of the resin constituting the resin particle of the magnetic material-dispersed carrier particle include an acrylic resin, a styrene acrylic resin, a polyester, a fluororesin and a phenol resin.

The size of the carrier particle is preferably in the range from 15 to 100 μm, more preferably in the range from 25 to 60 μm as a volume average particle size. The content of the carrier particle in the toner is, for example, an amount that allows the concentration of the toner particle to be 6 to 8 mass %. The volume average particle size of the carrier particle can be measured by, for example, the same method as in the particle size of the external additive.

The average particle size of the toner particle is preferably in the range from 3.0 to 8.0 μm, more preferably in the range from 4.0 to 7.5 μm as a volume average particle size from the viewpoints that the occurrence of offset in fixation due to flying of the toner to a heating member in fixation is suppressed, transfer efficiency is enhanced and flow ability of the toner is enhanced. The average particle size of the toner particle can be determined by measuring the volume average particle size with "Coulter Multisizer 3" (manufactured by Beckman Coulter, Inc.), and can be controlled by the concentration of an aggregating agent and the amount of a solvent to be added in aggregation and fusion steps in production of the toner, the fusion time in the aggregation and fusion steps, or the composition of the binder resin.

The average circularity of the toner particle is preferably in the range from 0.920 to 1.000, more preferably in the range from 0.940 to 0.995 from the viewpoint that transfer efficiency is enhanced. The average circularity is represented by the following expression. In the following expression, L0 represents the boundary length of a projection image of the particle (μm), and L1 represents the boundary length of a circle, determined from the equivalent circle size of the particle (μm). The average circularity can be measured by, for example, an average circularity measurement apparatus "FPIA-2100" (manufactured by Sysmex Corporation).

$$\text{Average circularity}=L1/L0$$

The toner base particle preferably has a lamella structure therein from the viewpoint that recrystallization of the crystalline resin is facilitated and low-temperature fixability and other characteristics above are thus easily simultaneously satisfied. For example, while the crystalline polyester largely contributes to low-temperature fixability, the crystalline polyester cannot sufficiently exert the effect of enhancing low-temperature fixability in some cases depending on the form thereof present in the toner. When the lamella structure of the crystalline polyester is present at desired position and size, melting of the binder resin is thus more effectively promoted and low-temperature fixability is more effectively exerted from there.

Figure 2A:
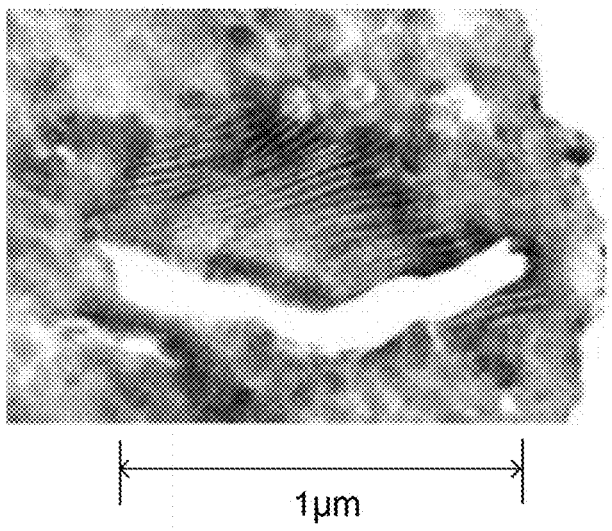
FIG. 2A illustrates an electron micrograph of one example of a lamella structure in a toner according to an embodiment of the present invention.

The lamella structure corresponds to a lamellar crystal structure, and means a layered structure in which two or more layers made of the molecular chain of the crystalline resin are laminated. FIG. 2A illustrates an electron micrograph of one example of the lamella structure of the toner. Examples of the lamella structure include a layered structure generated by folding of the molecular chain of the crystalline resin, and a layered structure generated by crystallization of the molecular chain of the crystalline resin. The lamella structure of the crystalline polyester is present in a domain portion of the lamella structure, namely, in a matrix being a continuous phase, as an island phase having a closed interface (boundary between phases).

Figure 2B:
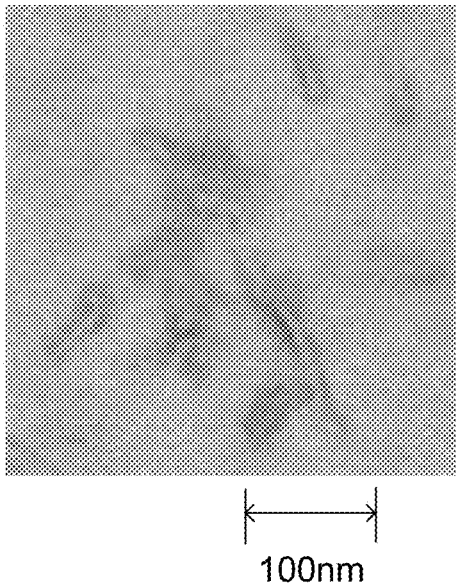
FIG. 2B illustrates an electron micrograph of one example of a thread-like structure in the toner.

Examples of a structure at a molecular level that can be taken in the crystalline resin, other than the lamella structure, include a thread-like structure. The thread-like structure means a structure in which the molecular chain is not accumulated to such an extent that the layered structure is constructed. FIG. 2B illustrates an electron micrograph of one example of the thread-like structure in the toner. The thread-like structure is lower than the lamella structure in terms of the ability thereof as origination (initiator) to initiate melting of the toner base particle.

The lamella structure can be achieved depending on, for example, the type of the material (monomer) of the binder resin. For example, use of a monomer having a configuration close to the crystalline material such as 2-EHA, as the monomer of the amorphous resin, in the case of the styrene acrylic resin, or use of dodecenylsuccinic acid as the monomer of the crystalline polyester can be effective for introduction of the lamella structure.

The toner base particle preferably has a core-shell structure from the viewpoint that heat resistance (for example, high-temperature storage property) and low-temperature fixability are easily simultaneously satisfied.

The method of producing the toner particle is not limited, and examples thereof include known polymerization methods such as a suspension polymerization method, an emulsion polymerization aggregation method and a dispersion polymerization method. The toner particle may be, for example, a particle having a core-shell structure in which the surface of a core particle including a core resin is coated with a shell layer including a shell resin, or a particle having a mono-layer structure not having such a shell layer. In the case of the particle having a core-shell structure, the shell resin forming the shell layer is preferably an amorphous resin.

While a toner base particle dried, obtained by the method of producing the toner particle, may be used for the toner as it is, a known external additive is added to the toner base particle to provide a toner particle by a dry method in which an external additive is added and mixed, and the toner particle may be used for the toner of the present invention. For the mixing apparatus of the external additive, known various mixing apparatuses such as a TURBULA MIXER, a HENSCHEL MIXER, a NAUTA MIXER and a V-type mixing machine can be used.

Hereinafter, as the method of producing the toner, a method of producing a yellow toner is specifically described in detail. With respect to a method of producing any toner other than a yellow toner, such as a magenta toner, a cyan toner or a black toner, a colorant to be used can be changed and the method of producing a yellow toner can be suitably adopted. The method of producing a toner according to the present invention is not limited to the following.

<Preparation of Aqueous Dispersion Liquid of Colorant Fine Particle>

Sodium dodecyl sulfate is dissolved in ion-exchange water with stirring, and a yellow colorant is added to the resulting aqueous solution and subjected to a dispersing treatment to thereby prepare an aqueous dispersion liquid of a colorant fine particle, in which a yellow colorant fine particle is dispersed.

<Preparation of Aqueous Dispersion Liquid of Release Agent-Containing Amorphous Vinyl Polymer>

(First Polymerization)

Sodium dodecyl sulfate and ion-exchange water are charged in a reaction vessel equipped with a stirring apparatus, a temperature sensor, a condenser and a nitrogen introduction apparatus, and heated with stirring in a nitrogen gas stream, an aqueous initiator solution in which potassium persulfate is dissolved in ion-exchange water is added, and a monomer-mixed liquid including, for example, styrene (St) as a styrene monomer, n-butyl acrylate (BA) as a (meth)acrylic acid ester monomer, methacrylic acid (MAA) as a compound having a carboxy group [—COOH] or a hydroxy group [—OH], and the like is dropped, and thereafter subjected to polymerization with heating and stirring to prepare dispersion liquid (1) of a resin fine particle.

(Second Polymerization)

A solution in which polyoxyethylene (2) dodecyl ether sodium sulfate is dissolved in ion-exchange water is charged in a reaction vessel equipped with a stirring apparatus, a temperature sensor, a condenser and a nitrogen introduction apparatus, and heated. Thereafter, a solution in which monomers and a release agent are dissolved, the solution including dispersion liquid (1) of a resin fine particle, and, for example, styrene (St) as a styrene monomer, n-butyl acrylate as a (meth)acrylic acid ester monomer, methacrylic acid (MAA) and n-octyl-3-mercaptopropionate as compounds having a carboxy group [—COOH] or a hydroxy group [—OH], and a release agent (behenic acid/behenate (melting point: 73° C.)), is added, and mixed and dispersed to prepare a dispersion liquid including an emulsified particle (oil droplet).

Next, to the dispersion liquid is added an aqueous initiator solution in which potassium persulfate is dissolved in ion-exchange water, and the system is subjected to polymerization with heating and stirring, to prepare dispersion liquid (2) of a resin fine particle.

(Third Polymerization)

After ion-exchange water is added to dispersion liquid (2) of a resin fine particle and well stirred, an aqueous initiator solution in which potassium persulfate is dissolved in ion-exchange water is added, and a monomer-mixed liquid including, for example, styrene (St) as a styrene monomer, n-butyl acrylate (BA) as a (meth)acrylic acid ester monomer, methacrylic acid (MAA) as a compound having a carboxy group [—COOH] or a hydroxy group [—OH], n-octyl-3-mercaptopropionate, and the like is dropped. After completion of the dropping, the resultant is subjected to polymerization by heating and stirring, and thereafter cooled to prepare an aqueous dispersion liquid of a release agent-containing amorphous vinyl polymer.

<Preparation of Aqueous Dispersion Liquid of Crystalline Polyester>

(Synthesis of Crystalline Polyester)

For example, styrene, n-butyl acrylate and acrylic acid, and a polymerization initiator (di-t-butyl peroxide), as raw material monomers and a radical polymerization initiator of an addition polymerization resin segment (that is here a styrene acrylic resin segment), are placed in a dropping funnel.

In addition, for example, sebacic acid as an aliphatic dicarboxylic acid and 1,12-dodecanediol as an aliphatic diol, as raw material monomers of a polycondensation resin segment (that is here a crystalline polyester segment), are placed in a four-neck flask equipped with a nitrogen introduction tube, a dehydration tube, a stirrer and a thermocouple, and heated and dissolved.

Next, the raw material monomers and the radical polymerization initiator of an addition polymerization resin segment, placed in the dropping funnel, are dropped with stirring to the solution heated and dissolved of the materials of a polycondensation resin segment, and aged, and the unreacted addition polymerization monomers are removed under reduced pressure. Thereafter, an esterification catalyst is loaded, and the resultant is heated, and subjected to a reaction under normal pressure and an additional reaction under reduced pressure. After cooling, the resultant is subjected to an additional reaction under reduced pressure to provide a crystalline polyester as a hybrid resin.

(Preparation of Aqueous Dispersion Liquid of Crystalline Polyester)

The crystalline polyester obtained in Synthesis Example above is dissolved in a solvent (for example, methyl ethyl ketone) with stirring. Next, to the solution is added an aqueous sodium hydroxide solution. Water is dropped and mixed with stirring of the solution, to thereby prepare an emulsified liquid. Next, the solvent is removed by distillation from the emulsified liquid, to thereby prepare an aqueous dispersion liquid in which the crystalline polyester is dispersed.

<Preparation of Aqueous Dispersion Liquid of Amorphous Polyester>

(Synthesis of Amorphous Polyester)

For example, a bisphenol A propylene oxide 2 mol adduct, terephthalic acid, fumaric acid and an esterification catalyst (for example, tin octylate) are placed in a reaction vessel equipped with a nitrogen introduction tube, a dehydration tube, a stirrer and a thermocouple, subjected to a polycondensation reaction and further a reaction under reduced pressure, and cooled.

Next, for example, a mixture of acrylic acid as a compound having a carboxy group [—COOH] or a hydroxy group [—OH], styrene as a styrene monomer, butyl acrylate as a (meth)acrylic acid ester monomer, and di-t-butyl peroxide as a polymerization initiator is dropped into the reaction vessel. After the dropping, the resultant is subjected to an addition polymerization reaction, thereafter heated, and kept under reduced pressure, and thereafter the compound having a carboxy group [—COOH] or a hydroxy group [—OH], the styrene monomer and the (meth)acrylic acid ester monomer are removed. Thus, an amorphous polyester in which a vinyl resin segment and a crystalline polyester segment are bound is synthesized.

(Preparation of Aqueous Dispersion Liquid of Amorphous Polyester)

The amorphous polyester obtained in Synthesis Example above is dissolved in a solvent (for example, methyl ethyl ketone) with stirring. Next, to the solution is added an aqueous sodium hydroxide solution. Water is dropped and mixed with stirring of the solution, to thereby prepare an emulsified liquid. Next, the solvent is removed by distillation from the emulsified liquid, to thereby prepare an aqueous dispersion liquid in which the amorphous polyester is dispersed.

<Production of Yellow Toner>

After the aqueous dispersion liquid of a release agent-containing amorphous vinyl polymer, and ion-exchange water are loaded into a reaction vessel equipped with a stirring apparatus, a temperature sensor and a condenser, an aqueous sodium hydroxide solution is added thereto to adjust the pH.

Thereafter, the aqueous dispersion liquid of a colorant fine particle is loaded to the reaction vessel, and an aqueous magnesium chloride solution is then added thereto to prepare a mixed liquid. The mixed liquid is heated, and the aqueous dispersion liquid of a crystalline polyester is further added to the mixed liquid to allow aggregation to progress. When the size of an aggregated particle reaches a desired particle size, the aqueous dispersion liquid of an amorphous polyester is loaded, and an aqueous solution in which sodium chloride is dissolved in ion-exchange water is added to stop growth of the particle. Thereafter, the mixed liquid is heated and stirred to thereby allow fusion of the particle to progress, and the resultant is thereafter cooled.

Next, the mixed liquid is subjected to solid-liquid separation, and the resulting solid (toner base particle) is washed and thereafter dried to thereby provide a yellow toner base particle. To the resulting toner base particle is added an external additive, to thereby produce a yellow toner particle.

(Method of Producing Yellow Toner)

A known ferrite carrier is added to the yellow toner particle in an amount so that the toner concentration is 6 to 8 mass %, and the resultant is mixed to thereby produce a yellow toner.

The toner is used for a known electrophotographic image forming method according to an ordinary method. The toner is useful for formation of a high-quality image because of sufficiently having not only low-temperature fixability, but also all of high-temperature storage property, document offset resistance and smear resistance, as described above, and is also useful in terms of toner distribution because of being also excellent in storage stability.

As is clear from the above description, the toner has a toner base particle that contains a binder resin including a crystalline resin, and a release agent, and $G'_{MAX}$ thereof is 2.2 or more. Accordingly, the toner sufficiently has all of low-temperature fixability, high-temperature storage property, document offset resistance and smear resistance, while containing a crystalline resin.

The $G'_{5^\circ C./min}$ equal to or less than the $G'_{1^\circ C./min}$ at a temperature equal to or lower than the Tm is much more effectively from the viewpoint that the temperature range in which $G'_{MAX}$ is satisfied in the toner is more expanded.

The ratio of the $C'_{1^\circ C./min}$ to the $G'_{5^\circ C./min}$ of 1 or more and 1.4 or less at a temperature higher than the Tm is much more effectively in terms of low-temperature fixability.

The $G'_{MAX}$ of 3.6 or more and 6.2 or less is much more effectively from the viewpoint that a crystal state suitable for a fixing process in an image forming apparatus is realized.

The Tm of 65° C. or higher and 90° C. or lower is much more effectively in terms of given thermal properties (high-temperature storage property, document offset resistance and low-temperature fixability) of the toner.

The melting point Tmc of the crystalline resin or 60° C. or higher and 85° C. or lower is much more effectively in terms of low-temperature fixability and high-temperature storage property.

The crystalline resin being a crystalline polyester is much more effectively in terms of low-temperature fixability, and the crystalline resin being a hybrid crystalline polyester is much more effectively from the viewpoint that the degree of crystallization of the crystalline resin, suitable for a fixing process in an image forming apparatus, is realized.

The content of the crystalline resin in the toner base particle of 2 mass % or more and 20 mass % or less is much more effectively from the viewpoint that low-temperature fixability is enhanced.

The toner having a lamella structure therein is much more effectively from the viewpoint that recrystallization of the crystalline resin in cooling and solidification of the toner molten is promoted.

The toner having a core-shell structure is much more effectively from the viewpoint that low-temperature fixability and high-temperature storage property are simultaneously satisfied.

Thus, the present embodiment can provide a toner containing a crystalline resin, the toner sufficiently having all of low-temperature fixability, high-temperature storage property, document offset resistance and smear resistance.

EXAMPLES (Synthesis of Amorphous Polyester A)

The following components were charged in the following amounts into a reaction vessel equipped with a stirring apparatus, a nitrogen introduction tube, a temperature sensor and a rectifying column, and the temperature of the content in the reaction vessel was raised to 190° C. over 1 hour. "Fumaric acid" and "Terephthalic acid" correspond to polyvalent carboxylic acids. In addition, "2,2-BPPO" represents a "2,2-bis(4-hydroxyphenyl)propane propylene oxide 2 mol adduct", "2,2-BPEO" represents a "2,2-bis(4-hydroxyphenyl)propane ethylene oxide 2 mol adduct", and these correspond to polyhydric alcohols.

| | |
|---|---|
| Fumaric acid | 1.8 parts by mass |
| Terephthalic acid | 29.2 parts by mass |
| 2,2-BPPO | 58.2 parts by mass |
| 2,2-BPEO | 6.7 parts by mass |

After the content was confirmed to be uniformly stirred, dibutyltin oxide in an amount of 0.006 mass % relative to the total amount of the polyvalent carboxylic acids was loaded as a catalyst into the reaction vessel, and the temperature of the content was raised from the temperature to 240° C. over 6 hours while water generated was distilled off. When the temperature reached 240° C., 2.4 parts by mass of trimellitic acid was further added and thereafter a dehydration condensation reaction was continued to perform a polymerization reaction until the acid value of a product reached 21 mgKOH/g at 240° C., thereby providing amorphous polyester A.

Amorphous polyester A obtained had a number average molecular weight (Mn) of 3,600 and a glass transition temperature (Tg) of 62° C.

(Preparation of Aqueous Dispersion Liquid A of Fine Particle of Amorphous Polyester A)

To a reaction vessel having an anchor blade for imparting a stirring power were added 240 parts by mass of methyl ethyl ketone and 60 parts by mass of isopropyl alcohol (IPA), and nitrogen was supplied thereto to replace air in the system. Next, 300 parts by mass of amorphous polyester A was slowly added to the mixed solvent with heating of the mixed solvent to 60° C. by an oil bath apparatus, and was dissolved with stirring. Next, to the resulting solution was added 20 parts by mass of 10% ammonia water, and thereafter 1,500 parts by mass of deionized water was loaded through a metering pump with stirring of the solution. It was confirmed that the liquid in the reaction vessel had an opaque white color and the stirring viscosity was reduced, and it was thus confirmed that emulsification was conducted.

Thereafter, the resultant was transferred to a separable flask having a stirring blade, a reflux apparatus and a vacuum pump as a decompression apparatus, the flask allowing an emulsified liquid to be pumped by the differential pressure based on a centrifugal force to form a wetting wall on the wall of a reaction tank. While the emulsified liquid was continuously stirred, the solvent and a dispersion medium were distilled off under reduced pressure at a wall temperature of the reaction tank of 58° C. A time point where the amount of the dispersion liquid in the emulsified liquid reached 1,000 parts by mass was defined as an end point of the concentrating under reduced pressure, the pressure in the reaction tank was turned to normal pressure, and the resultant was cooled to normal temperature with stirring to provide aqueous dispersion liquid A of a fine particle of amorphous polyester A, having a solid content of 30 mass %. The median size D50v on a volume basis of the fine particle of amorphous polyester A in aqueous dispersion liquid A was 162 nm.

(Synthesis of Crystalline Polyester 1)

The following raw material monomers and radical polymerization initiator (di-t-butyl peroxide) of an addition polymerization resin (styrene acrylic resin: StAc) unit having di-reactive monomers were placed in a dropping funnel in the following amounts to provide monomer liquid 1A.

| | |
|---|---|
| Styrene | 43.5 parts by mass |
| n-Butyl acrylate | 16 parts by mass |
| Acrylic acid | 3.5 parts by mass |
| Di-t-butyl peroxide | 8 parts by mass |

In addition, the following raw material monomers of a polycondensation resin (crystalline polyester: CPEs) unit were placed in a four-neck flask equipped with a nitrogen introduction tube, a dehydration tube, a stirring machine and a thermocouple in the following amounts, and heated to 170° C. and dissolved.

| | |
|---|---|
| Tetradecanedioic acid | 358 parts by mass |
| Hexanediol | 145 parts by mass |

Next, monomer liquid 1A was dropped to the monomer liquid in the four-neck flask with stirring over 90 minutes and aged for 60 minutes, and thereafter the unreacted addition polymerization monomers were removed from the four-neck flask under reduced pressure (8 kPa). The amounts of the monomers removed were very small as compared with the amounts in monomer liquid 1A.

Thereafter, 0.8 parts by mass of $Ti(OBu)_4$ as an esterification catalyst was loaded to the mixed liquid in four-neck flask, the mixed liquid was heated to 235° C., and subjected to a reaction under normal pressure (101.3 kPa) for 5 hours and an additional reaction under reduced pressure (8 kPa) for 1 hour. The resulting mixed liquid was cooled to 200° C., and thereafter further subjected to a reaction under reduced pressure (20 kPa) for 1 hour to thereby provide crystalline polyester 1.

Crystalline polyester 1 included 10 mass % of the resin (StAc) unit other than CPEs relative to the total amount thereof, and was a resin in which CPEs was grafted to StAc. Crystalline polyester 1 obtained had a number average molecular weight (Mn) of 9,000 and a melting point (Tmc) of 72° C.

(Synthesis of Crystalline Polyester 2)

The same manner as in Synthesis of crystalline polyester 1 was performed except that the raw material monomers of the CPEs unit were changed as follows, to thereby provide crystalline polyester 2. Crystalline polyester 2 had a Mn of 7,000 and a Tmc of 63° C.

| | |
|---|---|
| Adipic acid | 236 parts by mass |
| 1,10-Decanediol | 241 parts by mass |

(Synthesis of Crystalline Polyester 3)

The same manner as in Synthesis of crystalline polyester 1 was performed except that the composition of the monomer liquid of the StAc unit was changed as follows, to thereby provide crystalline polyester 3. Crystalline polyester 3 had a Mn of 11,000 and a Tmc of 69° C.

| | |
|---|---|
| Styrene | 87 parts by mass |
| n-Butyl acrylate | 32 parts by mass |
| Acrylic acid | 7 parts by mass |
| Di-t-butyl peroxide | 16 parts by mass |

(Synthesis of Crystalline Polyester 4)

The same manner as in Synthesis of crystalline polyester 1 was performed except that dropping and aging of the monomer liquid of the StAc unit, and removal of the unreacted monomers under reduced pressure were not performed, to thereby provide crystalline polyester 4. Crystalline polyester 4 had a Mn of 6,000 and a Tmc of 75° C.

(Synthesis of Crystalline Polyester 5)

The same manner as in Synthesis of crystalline polyester 2 was performed except that dropping and aging of the monomer liquid of the StAc unit, and removal of the unreacted monomers under reduced pressure were not performed, to thereby provide crystalline polyester 5. Crystalline polyester 5 had a Mn of 6,000 and a Tmc of 65° C.

(Preparation of Aqueous Dispersion Liquid 1C of Fine Particle of Crystalline Polyester 1)

In 82 parts by mass of methyl ethyl ketone was dissolved 82 parts by mass of crystalline polyester 1 with stirring at 70° C. for 30 minutes. Next, to this solution was added 2.5 parts by mass of an aqueous 25 mass % sodium hydroxide solution (degree of neutralization: approximately 50%). The resulting solution was placed in a reaction vessel having a stirring machine, and 236 parts by mass of water warmed to 70° C. was dropped in and mixed with the solution with stirring over 70 minutes. The solution was clouded in the dropping, and a homogenous emulsion was obtained after the total amount of the water was dropped. The volume average particle size of the oil droplet of the emulsion was measured by a laser diffraction type particle size distribution analyzer "LA-750 (manufactured by Horiba, Ltd.)", and was 123 nm.

Next, the emulsion was stirred with a diaphragm vacuum pump "V-700" (manufactured by BUCHI Labortechnik AG) under a reduced pressure of 15 kPa (150 mbar) for 3 hours with being kept warm at 70° C., to thereby remove methyl ethyl ketone by distillation, producing "aqueous dispersion liquid 1C of fine particle of crystalline polyester 1" (solid content: 25 mass %), in which the fine particle of crystalline polyester 1 was dispersed. The volume average particle size of the fine particle of crystalline polyester 1 in aqueous dispersion liquid 1C was measured by the particle size distribution analyzer, and was 75 nm.

(Preparation of Aqueous Dispersion Liquids 2C to 5C of Fine Particles of Crystalline Polyesters 2 to 5)

The same preparation as in aqueous dispersion liquid 1C described above was performed except that each of crystalline polyesters 2 to 5 was used instead of crystalline polyester 1, to thereby prepare each of aqueous dispersion liquids 2C to 5C of fine particles of crystalline polyesters 2 to 5. The respective volume average particle sizes of fine particles of crystalline polyesters 2 to 5 in aqueous dispersion liquids 2C to 5C were 400 nm.

The compositions of aqueous dispersion liquids 1C to 5C of fine particles of crystalline polyesters 1 to 5, and the melting points of crystalline polyesters 1 to 5 are shown in Table 1.

TABLE 1

| Aqueous dispersion liquid No. | CPEs No. | Composition (parts by mass) CPEs unit | StAc unit | Tmc (° C.) |
|---|---|---|---|---|
| 1C | 1 | 90 | 10 | 72 |
| 2C | 2 | 90 | 10 | 63 |
| 3C | 3 | 80 | 20 | 69 |
| 4C | 4 | 100 | 0 | 75 |
| 5C | 5 | 100 | 0 | 65 |

(Preparation of Aqueous Dispersion Liquid 1A of Fine Particle of Amorphous Resin 1)

(First-Stage Polymerization)

Eight parts by mass of sodium dodecyl sulfate and 3 L of ion-exchange water were charged in a 5-L reaction vessel equipped with a stirring apparatus, a temperature sensor, a condenser and a nitrogen introduction apparatus, and the internal temperature was raised to 80° C. in a nitrogen gas stream with stirring at a stirring rate of 230 rpm. After the temperature rise, to the resulting aqueous solution was added an aqueous initiator solution in which 10 parts by mass of potassium persulfate was dissolved in 200 parts by mass of ion-exchange water, and the temperature of the solution was again turned to 80° C.

Next, in the resulting mixed liquid were dropped a monomer-mixed liquid containing the following components in the following amounts over 1 hour, and thereafter subjected to polymerization with heating and stirring at 80° C. for 2 hours to thereby prepare dispersion liquid x1 of a resin fine particle.

| | |
|---|---|
| Styrene | 480 parts by mass |
| n-Butyl acrylate | 250 parts by mass |
| Methacrylic acid | 68.0 parts by mass |

(Second-Stage Polymerization)

An aqueous solution in which 7 parts by mass of polyoxyethylene (2) dodecyl ether sodium sulfate was dissolved in 3 L of ion-exchange water was charged in a 5-L reaction vessel equipped with a stirring apparatus, a temperature sensor, a condenser and a nitrogen introduction apparatus, and heated to 80° C. Thereafter, to the aqueous solution were added 269 parts by mass of dispersion liquid x1 of a resin fine particle, and a raw material solution dissolved at 80° C. containing the following components in the following amounts, and mixed and dispersed by a mechanical dispersing machine "CLEARMIX" having a circulation pathway (manufactured by M Technique Co., Ltd., "CLEARMIX" being the registered trademark of the company) for 1 hour, to thereby prepare a dispersion liquid including an emulsified particle (oil droplet). "Behenyl behenate" corresponded to a release agent, and the melting point thereof was 73° C.

| | |
|---|---|
| Styrene | 284 parts by mass |
| 2-Ethylhexyl acrylate | 87 parts by mass |
| Methacrylic acid | 28 parts by mass |
| n-Octyl-3-mercaptopropionate | 6.4 parts by mass |
| Behenyl behenate | 140 parts by mass |

Next, to the dispersion liquid was added an aqueous initiator solution in which 5.6 parts by mass of potassium persulfate was dissolved in 200 mL of ion-exchange water, and the resulting mixed liquid was subjected to polymerization with heating and stirring at 84° C. over 1 hour to prepare dispersion liquid x2 of a resin fine particle.

(Third-Stage Polymerization)

Furthermore, to dispersion liquid x2 of a resin fine particle was added 400 mL of ion-exchange water and well mixed, and thereafter an aqueous initiator solution in which 6.6 parts by mass of potassium persulfate was dissolved in 400 mL of ion-exchange water was further added. The resulting dispersion liquid was heated to 82° C., and a monomer-mixed liquid containing the following components in the following amounts was dropped over 1 hour.

| | |
|---|---|
| Styrene | 430 parts by mass |
| n-Butyl acrylate | 155 parts by mass |
| Methacrylic acid | 51 parts by mass |
| n-Octyl-3-mercaptopropionate | 10.2 parts by mass |

After completion of the dropping, the resultant was subjected to polymerization with heating and stirring for 2 hours, and thereafter cooled to 28° C. to provide aqueous dispersion liquid 1A (solid content: 24 mass %) of a fine particle of amorphous resin 1 including a vinyl resin. The median size D50v on a volume basis of the fine particle of amorphous resin 1 in aqueous dispersion liquid 1A was 220 nm, and amorphous resin 1 had a glass transition temperature (Tg) of 55° C. and a weight average molecular weight (Mw) of 32,000.

(Preparation of Aqueous Dispersion Liquids 2A to 5A of Fine Particles of Amorphous Resins 2 to 5)

The same manner as in preparation of aqueous dispersion liquid 1A was performed except that the raw materials in second-stage polymerization and the amounts thereof were changed as shown in Table 2 below, to thereby provide each of aqueous dispersion liquids 2A to 5A with fine particles of amorphous resins 2 to 5 dispersed.

The fine particle of amorphous resin 2 in aqueous dispersion liquid 2A had a D50v of 215 nm, a Tg of 53° C. and a Mw of 28,000. The fine particle of amorphous resin 3 in aqueous dispersion liquid 3A had a D50v of 230 nm, a Tg of 52° C. and a Mw of 30,000. The fine particle of amorphous resin 4 in aqueous dispersion liquid 4A had a D50v of 210 nm, a Tg of 52° C. and a Mw of 25,000. The fine particle of amorphous resin 5 in aqueous dispersion liquid 5A had a D50v of 215 nm, a Tg of 51° C. and a Mw of 30,000.

The compositions of raw materials of amorphous resins 1 to 5 are shown in Table 2. In Table 2, "St" represents styrene, "BA" represents n-butyl acrylate, "MAA" represents methacrylic acid, "KPS" represents potassium persulfate, "2EHA" represents 2-ethylhexyl acrylate, "NOM" represents n-octyl-3-mercaptopropionate, "BB" represents behenyl behenate, "MC" represents microcrystalline wax (melting point: 89° C.), and "SS" represents stearyl stearate (melting point: 67° C.). The numerical values in Table 2 are represented by parts by mass.

TABLE 2

| Aqueous dispersion liquid | First-stage polymerization | | | | Second-stage polymerization | | | | | | | | | Third-stage polymerization | | | | |
|---|---|---|---|---|---|---|---|---|---|---|---|---|---|---|---|---|---|---|
| | | | | | Dispersion liquid | | | | | | | Release agent | | | | | | |
| No. | St | BA | MAA | KPS | ×1 | St | BA | 2EHA | MAA | NOM | KPS | Type | Amount | St | BA | MAA | NOM | KPS |
| 1A | 480 | 250 | 68 | 10 | 260 | 284 | — | 87 | 28 | 6.4 | 5.6 | BB | 140 | 430 | 155 | 51 | 10.2 | 6.6 |
| 2A | | | | | | | 87 | — | | | | BB | | | | | | |
| 3A | | | | | | | 43 | 44 | | | | BB | | | | | | |
| 4A | | | | | | | — | 87 | | | | MC | | | | | | |
| 5A | | | | | | | — | 87 | | | | SS | | | | | | |

(Preparation of Aqueous Dispersion Liquid Bk of Colorant Fine Particle)

Ninety parts by mass of polyoxyethylene-2-dodecyl ether sodium sulfate was added to 1,510 parts by mass of ion-exchange water and dissolved therein. While the resulting aqueous solution was stirred, 400 parts by mass of carbon black "REGAL 330" (produced by Cabot Corporation) was gradually added to the aqueous solution, and thereafter subjected to a dispersing treatment with a stirring apparatus "CLEARMIX" (manufactured by M Technique Co., Ltd.) to thereby prepare aqueous dispersion liquid Bk of a colorant fine particle, having a solid content of 20 mass %.

The average particle size (median size on a volume basis) of the colorant fine particle in aqueous dispersion liquid Bk was measured with "MICROTRAC UPA-150" (manufactured by Nikkiso Co., Ltd.), and was 110 nm.

Example 1: Production of Toner 1

In a reaction vessel equipped with a stirring apparatus, a temperature sensor, a condenser and a nitrogen introduction apparatus were charged 3,041 parts by mass of aqueous dispersion liquid 5A, 350 parts by mass of aqueous dispersion liquid Bk and 300 parts by mass of ion-exchange water, and an aqueous 5 mol/L sodium hydroxide solution was added with stirring to adjust the pH of the dispersion liquid in the reaction vessel to 10.5 (20° C.). Aqueous dispersion liquid 5A was an aqueous dispersion liquid of a fine particle of amorphous resin 5, and the amount thereof was 730 parts by mass as a solid content. Aqueous dispersion liquid Bk was an aqueous dispersion liquid of a colorant fine particle, and the amount thereof was 70 parts by mass as a solid content.

Next, to the dispersion liquid was added an aqueous solution, in which 160 parts by mass of chloride magnesium was dissolved in 160 parts by mass of ion-exchange water, at a rate of 10 parts by mass/min. After the resultant was left to stand for 5 minutes, temperature rise was initiated to heat the dispersion liquid to 80° C. over 60 minutes, and the fine particle in the dispersion liquid was aggregated at the temperature.

When the average particle size of the aggregated particle in the dispersion liquid reached 2.4 μm, 333 parts by mass of aqueous dispersion liquid 1C was added to the dispersion liquid over 10 minutes and heated to 85° C. to allow an additional aggregation reaction to progress. Aqueous dispersion liquid 1C was an aqueous dispersion liquid of a fine particle of crystalline polyester 1, and the amount thereof was 100 parts by mass as a solid content.

The aggregation reaction was periodically subjected to sampling to measure the median size on a volume basis of the aggregated particle with a particle size distribution analyzer "COULTER MULTISIZER 3" (manufactured by Beckman Coulter, Inc.). Stirring was continued, with the stirring rate being if necessary reduced, until the D50v of the aggregated particle reached 5.9 μm, to perform the aggregation reaction.

When the D50v of the aggregated particle reached 5.9 μm, the stirring rate was increased and 333 parts by mass of aqueous dispersion liquid A was added to the dispersion liquid over 40 minutes. Aqueous dispersion liquid A was an aqueous dispersion liquid of a fine particle of amorphous polyester A, and the amount thereof was 100 parts by mass as a solid content.

Thereafter, the dispersion liquid was sampled and the supernatant was confirmed to be transparent by centrifugation. Thereafter, an aqueous solution in which 300 parts by mass of sodium chloride was dissolved in 1,200 parts by mass of ion-exchange water was added to the dispersion liquid, the temperature of the dispersion liquid was set at 80° C. and stirring was continued. The average circularity of the particle in the dispersion liquid was measured by a flow particle image analyzer "FPIA-2100" (manufactured by Sysmex Corporation), and when the average circularity reached 0.961, the dispersion liquid was cooled to 30° C. at a rate of 6° C./min to stop a granulation reaction, thereby providing a dispersion liquid of colored particle 1. Colored particle 1 after cooling had an average particle size (D50v) of 6.1 μm and an average circularity of 0.961.

The dispersion liquid of colored particle 1 was subjected to solid-liquid separation with a basket centrifuge machine "MARK III Model 60×40" (manufactured by Matsumoto Machine Co., Ltd.), to provide a wet cake. The wet cake was washed and subjected to solid-liquid separation by the basket centrifuge machine repeatedly until the electrical conductivity of a filtrate was 15 μS/cm, and the wet cake after washing was supplied in small portions to "FLASH JET DRYER" (manufactured by Seishin Enterprise Co., Ltd.) and dried by blowing of a stream of air at a temperature of 40° C. and a humidity of 20% RH until the amount of water was about 2.0 mass %, and thereafter cooled to 24° C. Thereafter, a powder cake dried and cooled was transferred to a "VIBATION FLUIDIZED-LAYER APPARATUS" (manufactured by Chuo Kakouki Co., Ltd.), and the powder cake was dried at 40° C. for 2 hours. Thus, toner base particle 1 having an amount of water of 0.5% or less was obtained.

Toner base particle 1 was subjected to a treatment with an external additive to thereby provide toner particle 1. In the treatment with an external additive, hydrophobic silica was added in an amount of 1 mass % and also hydrophobic titanium oxide was added in an amount of 1.2 mass % to toner base particle 1, and mixed by a "HENSCHEL MIXER" (manufactured by Nippon Coke & Engineering. Co., Ltd.) at a peripheral speed of a rotor blade of 24 mm/sec for 20 minutes, and thereafter a coarse particle was removed with a 400-mesh sieve.

A ferrite carrier particle having a volume average particle size of 32 μm, in which toner particle 1 was coated with an acrylic resin, was added and mixed so that the concentration of the toner particle was 6 mass %, to provide toner 1 as a two-component developer for a black color.

Examples 2 to 7 and Comparative Examples 1, 2: Production of Toners 2 to 9

The same manner as in production of toner 1 was performed except that the type and the amount of the aqueous dispersion liquid were changed as shown in Table 3, to thereby produce each of toners 2 to 9.

Resin compositions of toners 1 to 9 are shown in Table 3. In Table 3, the content represents the content in the toner base particle. In Table 3, "APEs" represents an amorphous polyester.

TABLE 3

| | | Amorphous resin | | | | | CPEs | | | | |
|---|---|---|---|---|---|---|---|---|---|---|---|
| | | Aqueous dispersion | | | APEs | | Aqueous dispersion | | | Colorant | |
| | Toner No. | liquid No. | Type | Content (mass %) | Type | Content (mass %) | liquid No. | Type | Content (mass %) | Type | Content (mass %) |
| Example 1 | 1 | 5A | 5 | 73 | A | 10 | 1C | 1 | 10 | Bk | 7 |
| Example 2 | 2 | 1A | 1 | 75 | A | 10 | 1C | 1 | 8 | Bk | 7 |
| Example 3 | 3 | 3A | 3 | 75 | — | 0 | 3C | 3 | 18 | Bk | 7 |
| Example 4 | 4 | 5A | 5 | 85 | — | 0 | 2C | 2 | 8 | Bk | 7 |
| Example 5 | 5 | 4A | 4 | 73 | A | 10 | 1C | 1 | 10 | Bk | 7 |
| Example 6 | 6 | 5A | 5 | 80 | A | 10 | 3C | 3 | 3 | Bk | 7 |
| Example 7 | 7 | 2A | 2 | 73 | A | 10 | 4C | 4 | 10 | Bk | 7 |
| Comparative Example 1 | 8 | 4A | 4 | 63 | A | 10 | 4C | 4 | 20 | Bk | 7 |
| Comparative Example 2 | 9 | 2A | 2 | 53 | A | 10 | 5C | 5 | 30 | Bk | 7 |

(Evaluation)

(1) Measurement of Peak Top Temperature (Tm) of Endothermic Peak of Toner Particle Into an aluminum pan KITNO.B0143013 was 5 mg of each of toner particles 1 to 9, set in a sample holder of a thermal analysis apparatus "DIAMND DSC" (manufactured by PerkinElmer Co., Ltd.) and heated. In first heating, the peak top temperature Tm of the endothermic peak positioned at the highest temperature in temperature rise from 0° C. to 100° C. at a rate of temperature rise of 10° C./min was adopted.

(2) Measurement of Storage Elastic Modulus G'

Each of toner particles 1 to 9 was used as a measurement sample and the storage elastic modulus was measured by the above method.

Weighed was 0.2 g of each of toner particles 1 to 9, and pressure molding was performed by a compression molding machine with application of a pressure of 25 MPa, to produce a columnar pellet having a diameter of 10 mm. A rheometer "ARES G2" (manufactured by TA instruments. Japan) was used and a set of upper and lower parallel plates having a diameter of 8 mm was used to perform measurement in temperature drop at a frequency of 1 Hz. The sample was set at 100° C., the gap between the plates was set at 1.6 mm once, thereafter the sample protruded from the gap between the plates was scraped off, the gap was set at 1.4 mm, and the pellet was left to still stand for 10 minutes with an axial force being applied. Thereafter, the axial force was released, and the storage elastic modulus (G') was measured in temperature drop from 100° C. to 25° C. The rate of temperature drop was 1° C./min or 5° C./min, and a fresh sample was used to perform the measurement at each rate of temperature drop, to provide the curve of temperature variance.

Specific measurement conditions are shown below.

Frequency: 1 Hz

Rate of temperature drop (Ramp rate): 5° C./min or 1° C./min

Axial force: 0 g

Sensitivity: 10 g

Initial strain: 3.0%

Strain adjustment: 30.0%

Minimum strain: 0.01%

Maximum strain: 10.0%

Minimum torque: 1 g·cm

Maximum torque: 80 g·cm

Sampling interval: 1.0° C./pt (3) Observation of Cross Section of Toner Base Particle The cross section of each of toner base particles 1 to 9 was observed under the following apparatus and conditions.

Apparatus: transmission electron microscope "JEM-2000FX" (manufactured by JEOL Ltd.)

Specimen: section of toner base particle stained with ruthenium tetroxide ($RuO_4$) (thickness of section: 60 to 100 nm)

Acceleration voltage: 80 kV

Magnification: 50,000-fold, bright-field image out to an ultrathin section sample having a thickness of 60 to 100 nm by a microtome equipped with a diamond knife.

(Staining Conditions with Ruthenium Tetroxide)

Staining with ruthenium tetroxide was performed with a vacuum electron staining apparatus VSC1R1 (manufactured by Filgen Inc.). According to the procedure of an operating manual, a sublimation chamber including ruthenium tetroxide was disposed in the body of the staining apparatus. The ultrathin section prepared was introduced into a staining chamber, and thereafter was stained in staining conditions with ruthenium tetroxide, of room temperature (24 to 25° C.), a concentration of 3 (300 Pa) and a time of 10 minutes.

(Confirmation of Lamella Structure in Cross Section of Toner Base Particle)

An image of the cross section of the toner base particle was taken, within 24 hours after staining, by a transmission electron microscope "JEM-2000FX" (manufactured by JEOL Ltd.) at an acceleration voltage of 80 kV at 50,000-fold to confirm the presence of a lamella structure.

The physical properties and crystal structures of toners 1 to 9 are shown in Table 4. In Table 4, "$G'_{MAX}$ temperature" represents the temperature at which $G'_{1°\ C./min}$, $G'_{5°\ C./min}$ and $G'_{MAX}$ were measured, "Magnitude relationship at temperature of Tm or lower" represents the magnitude relationship between $G'_{1°C./min}$ and $G'_{5°\ C./min}$ at a temperature of Tm or lower, and "G'5≤G'1" represents $G'_{5°\ C./min}$ equal to or less than $G'_{1°\ C./min}$. In addition, "G' ratio at temperature higher than Tm" represents the ratio of $G'_{1°\ C./min}$ to $G'_{5°\ C./min}$ at a temperature higher than Tm, and represents the minimum value and the maximum value at the temperature. In addition, "lamella" means that a lamella structure was observed in the cross section of the toner base particle, and "thread-like" means that a thread-like structure was observed (no lamella structure was observed).

TABLE 4

| Toner No. | Tm (° C.) | $G'_{1°\ C./min}$ ($\times 10^6$ Pa) | $G'_{5°\ C./min}$ ($\times 10^6$ Pa) | $G'_{MAX}$ (-) | $G'_{MAX}$ temperature (° C.) | Magnitude Relationship at temperature of Tm or lower | G' ratio at temperature higher than Tm (-) | Crystal Structure in cross section |
|---|---|---|---|---|---|---|---|---|
| 1 | 72 | 22.3 | 4.41 | 5.06 | 60 | G'5 ≤ G'1 | 1.06 to 1.22 | Lamella |
| 2 | 73 | 38.0 | 6.79 | 5.6 | 58 | G'5 ≤ G'1 | 1.06 to 1.32 | Lamella |
| 3 | 75 | 113.5 | 49.4 | 2.3 | 50 | G'5 ≤ G'1 | 1.02 to 1.10 | Lamella |
| 4 | 67 | 2.82 | 0.74 | 3.8 | 62 | G'5 ≤ G'1 | 1.01 to 1.20 | Lamella |
| 5 | 89 | 9.85 | 2.31 | 4.2 | 61 | G'5 ≤ G'1 | 1.02 to 1.10 | Lamella |
| 6 | 69 | 4.54 | 0.73 | 6.2 | 58 | G'5 ≤ G'1 | 1.06 to 1.32 | Lamella |
| 7 | 75 | 27.5 | 4.30 | 6.4 | 65 | G'5 ≤ G'1 | 1.02 to 2.60 | Lamella |
| 8 | 89 | 30.4 | 17.6 | 1.7 | 55 | G'5 ≤ G'1 | 1.01 to 1.20 | Thread-like |
| 9 | 73 | 0.91 | 0.76 | 1.2 | 53 | G'5 ≤ G'1 | 1.02 to 1.10 | Thread-like |

(Method of Producing Section of Toner Base Particle)

To 35 mL of an aqueous 0.2% polyoxyethyl phenyl ether solution was added 3 parts by mass of each toner particle and dispersed, and thereafter subjected to ultrasonic (manufactured by Nippon Seiki Co., Ltd., US-1200T) at 25° C. for 5 minutes to remove the external additive from the surface of the toner particle, to provide a toner base particle for TEM observation.

Ten mg of the toner base particle was exposed once or twice in the following conditions using a vacuum electron staining apparatus VSC1R1 (manufactured by Filgen Inc.), thereafter dispersed in a photo-curable resin "D-800" (produced by JEOL Ltd.), and cured by irradiation with ultraviolet light to form a block. Next, the resulting block was cut (4) Evaluation of Low-Temperature Fixability Commercially available full-color multifunctional peripherals "BIZHUB C754" (manufactured by Konica Minolta Japan, Inc., "BIZHUB" being the registered trademark of the company) altered were used for an image forming apparatus. The peripherals altered served as an image forming apparatus altered so that the surface temperatures of a fixing belt in a fixing apparatus and a pressure roller of the full-color multifunctional peripherals could be adjusted. The evaluation test of the low-temperature fixability was performed by accommodating each of toners 1 to 9 in the peripherals altered, and outputting a solid image with an amount of each of toners 1 to 9 attached of 11.3 g/m$^2$, on A4 (basis weight: 80 g/m$^2$) normal paper in conditions of a nip width of 11.2 mm, a fixation time of 34 msec, a fixation pressure of 133 kPa and a fixation temperature of 100 to 200° C.

In the evaluation test, the fixation temperature was changed within the above range by 5° C., and the solid image was formed at each fixation temperature. The solid image formed was then visually observed, and the minimum fixation temperature, among fixation temperatures at which a solid image without any smear due to offset in fixation observed was formed, was defined as the minimum fixation temperature FTmin. The low-temperature fixability can be rated as Excellent at a minimum fixation temperature of less than 135° C., as Good at 135° C. or higher and lower than 150° C., as Practicable at 150° C. or higher and lower than 155° C., and as Poor at 155° C. or higher.

(5) Evaluation of Smear Resistance

An image including a patch portion with a density of 1.00±0.05 was formed on the normal paper at a fixation temperature higher than the minimum fixation temperature by 10° C., the patch portion was smeared 14 times with a plain-woven bleached cotton cloth at a load of 22 g/cm$^2$, the image density of the patch portion was measured with a MACBETH REFLECTION DENSITOMETER "RD-918" before and after smearing, and the fixation rate in smearing Rrf was calculated based on the following expression. A fixation rate in smearing of 80% or more can have no problem in practical use. In the following expression, "$ID_0$" represents the image density before smearing, and "$ID_1$" represents the image density after smearing.

$$Rrf\ (\%)=(ID_1/ID_0)\times 100$$

(6) Evaluation of Image Storage Property (Document Offset Resistance)

A double-sided printed image was continuously output for 100 sheets at a fixation temperature higher than the minimum fixation temperature by 15° C. The double-sided printed image was one in which a solid image with an amount of the toner attached of 5 mg/cm$^2$ was fixed on one surface of the normal paper, a character image with letters of the alphabet (6.0 point) printed in 36 lines was fixed on the upper half of the other surface thereof and a solid image with an amount of the toner attached of 5 mg/cm$^2$ was fixed on the lower half of the other surface thereof.

Such 100 double-sided printed products output were aligned into a stack and placed on a marble table as they were, and a weight was put on the stack so that a pressure of about 19.6 kPa (200 g/cm$^2$) was applied. The stack was kept to stand in such a state in an environment of a temperature of 30° C. and a humidity of 60% RH for 3 days, thereafter the printed products stacked were separated from one another, the degrees of loss on the images fixed of the products stacked were confirmed visually, for example, and the results were rated according to the following evaluation criteria. Ratings "Excellent (A)", "Good (B)" and "Practicable (C)" were defined as passing.

(Evaluation Criteria)

Excellent (A): neither an image defect due to transfer of the toner nor slight sticking between the images fixed was observed, and there was no problem about image loss at all.

Good (B): while a crackling sound was heard in separation of two printed products stacked, no image defect was observed and there was no problem about image loss.

Practicable (C): while a slight variation in gloss was observed on the images fixed, in separation of two printed products stacked, no image defect was observed and there was almost no image loss.

Poor (D): image transfer was observed in the background region of the character image, or the character image was transferred also into the background region brought into contact with the character image, and thus loss of the character image or a protrusion in the background region was observed.

(7) Evaluation of High-Temperature Storage Property

Into a 10-mL glass bottle having an inner diameter of 21 mm was loaded 0.5 g of each of toners 1 to 9, and the lid was closed. After the glass bottle was shaken 600 times by a shaking machine "TAP DENSER KYT-2000" (manufactured by Seishin Enterprise Co., Ltd.) at room temperature, the glass bottle with the lid being opened was placed in an environment of a temperature of 55° C. and a humidity of 35% RH and left to stand for 2 hours. Next, the total amount of the toner in the glass bottle was carefully loaded on a 48-mesh (opening: 350 μm) sieve so that the aggregate of the toner was not broken. Next, the sieve was set to "POWER TESTER" (manufactured by Hosokawa Micron Corporation) and secured by a pressing bar and a knobnut, and vibration was applied thereto for 10 seconds with the vibration strength being adjusted so that the feeding width was 1 mm.

The mass of the toner passing through the sieve was measured, and the rate passing through the sieve Rp was calculated by the following expression. In the following expression, "$W_0$" represents the mass (g) of the toner loaded on the sieve, and "$W_1$" represents the mass (g) of the toner remaining on the sieve. The high-temperature storage property of each of toners 1 to 9 was evaluated based on the resulting rate passing through the sieve. As the rate passing through the sieve was higher, aggregation in storage at a high temperature less occurred and high-temperature storage property was good. A rate passing through the sieve of 80% or less was defined as passing.

$$Rp\ (\%)=\{(W_0-W_1)/W_0\}\times 100$$

The evaluation results of toners 1 to 9 in the evaluation test are shown in Table 5. In Table 5, "D-off Res" represents "document offset resistance".

TABLE 5

| Toner No. | FTmin (° C.) | Rrf (%) | D-off Res | Rp (%) |
|---|---|---|---|---|
| 1 | 138 | 88 | A | 93 |
| 2 | 134 | 90 | A | 94 |
| 3 | 132 | 80 | B | 85 |
| 4 | 140 | 83 | B | 88 |
| 5 | 145 | 85 | A | 90 |
| 6 | 154 | 95 | A | 95 |
| 7 | 149 | 93 | A | 96 |
| 8 | 128 | 75 | C | 84 |
| 9 | 125 | 65 | D | 79 |

As shown in Table 4 and Table 5, toners 1 to 7 were sufficiently good in all of low-temperature fixability, smear resistance, document offset resistance and high-temperature storage property.

On the contrary, toner 8 was insufficient in smear resistance, and toner 9 was insufficient in all of smear resistance, document offset resistance and high-temperature storage property. Such results were considered to be based on the following: $G'_{MAX}$ was small to thereby cause the amorphous resin and the crystalline resin to be excessively compatible in the toner base particle, not resulting in a properly local presence of the crystalline resin in the resin distribution in the toner base particle or the fixed image, and therefore the effect of enhancing thermal stability and mechanical strength due to the resin component was not sufficiently exerted.

INDUSTRIAL APPLICABILITY

The present invention allows an electrophotographic full-color image to simultaneously achieve temperature stability and mechanical strength of the image. Accordingly, the present invention is expected to allow a forming technique of an electrophotographic high-quality image to be developed and further widely used.

What is claimed is:

1. A toner for developing an electrostatic latent image comprising:

a toner base particle that contains a binder resin including a crystalline resin, and a release agent, wherein $G'_{MAX}$ is 2.2 or more, wherein the $G'_{MAX}$ represents a maximum value of a ratio of $G'_{1^\circ\ C./min}$ to $G'_{5^\circ\ C./min}$ at a temperature equal to or lower than Tm, the $G'_{5^\circ\ C./min}$ represents a storage elastic modulus (Pa) in temperature drop measured in the range from 100° C. to 25° C. in conditions of a frequency of 1 Hz and a rate of temperature drop of 5° C./min of the toner, the $G'_{1^\circ\ C./min}$ represents a storage elastic modulus (Pa) in temperature drop measured in the range from 100° C. to 25° C. in conditions of a frequency of 1 Hz and a rate of temperature drop of 1° C./min of the toner, and the Tm represents a peak top temperature (° C.) of an endothermic peak positioned at a highest temperature in a first temperature rise process at 10° C./min in differential scanning calorimetry of the toner, and wherein the crystalline resin is a hybrid crystalline polyester.

2. The toner according to claim 1, wherein the $G'_{5^\circ\ C./min}$ is equal to or less than the $G'_{1^\circ\ C./min}$.

3. The toner according to claim 1, wherein a ratio of the $G'_{1^\circ\ C./min}$ to the $G'_{5^\circ\ C./min}$ at a temperature higher than the Tm is 1 or more and 1.4 or less.

4. The toner according to claim 1, wherein the $G'_{MAX}$ is 3.6 or more and 6.2 or less.

5. The toner according to claim 1, wherein the Tm is 65° C. or higher and 90° C. or lower.

6. The toner according to claim 1, wherein a melting point Tmc of the crystalline resin is 60° C. or higher and 85° C. or lower.

7. The toner according to claim 1, wherein a content of the crystalline resin in the toner base particle is 2 mass % or more and 20 mass % or less.

8. The toner according to claim 1, having a lamella structure therein.

9. The toner according to claim 1, having a core-shell structure.

* * * * *